US011322836B2

(12) United States Patent
Kim et al.

(10) Patent No.: US 11,322,836 B2
(45) Date of Patent: May 3, 2022

(54) ANTENNA DEVICE

(71) Applicant: KMW INC., Hwaseong-si (KR)

(72) Inventors: Inho Kim, Hwaseong-si (KR); Oh-seog Choi, Suwon-si (KR); Hyoung-seok Yang, Hwaseong-si (KR); Jeong Uk Park, Hwaseong-si (KR); Jin Suk Seo, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 26 days.

(21) Appl. No.: 16/925,277

(22) Filed: Jul. 9, 2020

(65) Prior Publication Data

US 2020/0343629 A1 Oct. 29, 2020

Related U.S. Application Data

(63) Continuation of application No. PCT/KR2018/016589, filed on Dec. 24, 2018.

(30) Foreign Application Priority Data

Jan. 12, 2018 (KR) ..... 10-2018-0004286

(51) Int. Cl.
*H01Q 21/06* (2006.01)
*H01Q 1/52* (2006.01)
*H01Q 1/38* (2006.01)

(52) U.S. Cl.
CPC ..... *H01Q 1/523* (2013.01); *H01Q 1/38* (2013.01); *H01Q 21/065* (2013.01)

(58) Field of Classification Search
CPC ..... H01Q 1/523; H01Q 1/38; H01Q 21/065; H01Q 21/28; H01Q 1/521; H01Q 1/246; H01Q 21/00; H01Q 17/00
See application file for complete search history.

(56) References Cited

U.S. PATENT DOCUMENTS

2008/0094286 A1 4/2008 Le Bayon et al.
2012/0115548 A1* 5/2012 Shimizu ..... H01Q 21/26 455/562.1
2017/0264012 A1 9/2017 Clark et al.

FOREIGN PATENT DOCUMENTS

CN 205543221 U 8/2016
CN 106297457 A 12/2016
(Continued)

OTHER PUBLICATIONS

International Search Report for PCT/KR2018/016589 dated Apr. 4, 2019 and its English translation.
(Continued)

*Primary Examiner* — David E Lotter
(74) *Attorney, Agent, or Firm* — Insight Law Group, PLLC; Seung Lee

(57) ABSTRACT

The present disclosure provides a shield wall for shielding multiple individual antenna modules of a massive MIMO antenna from each other. A shield wall according to at least one embodiment of the present disclosure is formed by a plurality of staple-shaped unit partitions arrayed longitudinally of the shield wall, wherein the unit partitions are designed to have optimal widths and heights according to the frequency band in use, and are arranged at a predetermined interval or less with reference to the frequency band in use, thereby providing an antenna structure which satisfies both the X-POL isolation and CO-POL isolation characteristics and can be easily fabricated in a compact, lightweight design.

14 Claims, 30 Drawing Sheets

(56) References Cited

FOREIGN PATENT DOCUMENTS

| | | | |
|---|---|---|---|
| JP | 2012-104982 | A | 5/2012 |
| KR | 10-0269584 | B1 | 10/2000 |
| KR | 10-2008-0006415 | A | 1/2008 |
| KR | 10-2010-0019789 | A | 2/2010 |
| KR | 10-0963123 | B1 | 6/2010 |
| KR | 10-2011-0123715 | A | 11/2011 |

OTHER PUBLICATIONS

Chinese office action dated Mar. 2, 2020 from Chinese Patent Office for Chinese Application No. 201910019455.0.
Japanese office action dated Jun. 15, 2021 from Japanese Patent Office for Japanese Application No. 2020-538528 and its English translation.
Non-final office action dated Nov. 29, 2021 from Korean Patent Office for Korean Application No. 10-2019-0004286 and its English translation.

* cited by examiner

ANTENNA DEVICE

CROSS-REFERENCE TO RELATED APPLICATION

This application is a continuation application of International Application No. PCT/KR2018/016589, filed on Dec. 24, 2018, which claims priority to and benefit of Korean Patent Application No. 10-2018-0004286 filed on Jan. 12, 2018, the disclosures of which are incorporated by reference herein in their entirety.

TECHNICAL FIELD

The present disclosure in some embodiments relates to an antenna device of a massive MIMO antenna composed of a dual-polarized antenna array. More particularly, the present disclosure relates to a shield wall for shielding multiple dual-polarized antenna modules constituting a massive MIMO antenna from each other.

BACKGROUND

The statements in this section merely provide background information related to the present disclosure and do not necessarily constitute prior art.

A massive Multiple Input Multiple Output (MIMO) technique is a spatial multiplexing technique that utilizes multiple antennas to dramatically increase data transmission capacity, involving a transmitter for transmitting different data by each different transmit antenna and a receiver for distinguishing the transmit data through proper signal processing. The MIMO technique increases the number of both transmit and receive antennas leading to increased channel capacity for transmitting more data. For example, a 10-times increase of antennas can secure a channel capacity of about ten times for the same frequency band used as compared to employing a current single antenna system.

4th Generation (4G) Long Term Evolution-advanced (LTE-advanced) networks have utilized up to eight antennas, the present stage of pre-5G (5th generation) sees products being developed with 64 or 128 antennas installed, and a base station equipment in the 5G stage is expected to have a much larger number of antennas, which is referred to as a massive MIMO technology. While the current cell operation is 2-dimensional, the massive MIMO technology, enabling 3D-beamforming as it is introduced, is also called full dimension or FD-MIMO.

In the massive MIMO technology, the number of antenna elements increases, which in turn increases the weight and volume of the base station equipment altogether. Miniaturizing, weight lightening and performance-boosting of the relevant components are required taking account of the environment in which a base station is installed, such as a building rooftop, a skyscraping structure, etc., which, however, are hardly achieved due to at least a shield wall for minimizing the frequency interference between dual-polarized antennas.

DISCLOSURE

Technical Problem

The present disclosure in some embodiments provides a shield wall formed between multiple dual-polarized antennas by arranging a plurality of staple-shaped unit partitions seeking to replace a shield wall of a conventional thin plate type between dual-polarized antennas, thereby improving both the X-POL isolation and CO-POL isolation characteristics between the multiple dual-polarized antennas while achieving targeted miniaturization and lightening of the weight of an antenna device.

SUMMARY

To resolve the above matters, at least one aspect of the present disclosure provides an antenna device including a base substrate, an antenna module array, and a first shield wall. The antenna module array includes a plurality of antenna module strings arranged in a first direction, the antenna module strings each including at least one or more antenna modules that are dual-polarized and arrayed in a second direction perpendicular to the first direction on the base substrate. The first shield wall is disposed between the antenna module strings that are neighboring each other, the first shield wall being formed by a plurality of unit partitions arranged in the second direction and spaced apart from each other.

The first shield wall may be formed by unit partitions made of a conductive linear member.

The unit partitions may each include at least one or more vertical shield members having one ends mounted on the base substrate, and a horizontal shielding member connected to the vertical shield members and spaced apart from the base substrate by a first clearance height.

Multiples of the horizontal shield member may be arranged in a row along the second direction.

The horizontal shield member may be straight.

The horizontal shield member may have a length that allows a mutual frequency interference to be reduced in proportion to a reduced array spacing between the antenna modules, and that is less than an array spacing of the antenna module array in the first direction.

Multiples of the horizontal shielding member may have an array spacing determined to reduce mutual interference between the antenna modules due to radio waves reflected by the unit partitions, the array spacing including an array spacing that is measured in the second direction between the multiples of the horizontal shielding member to be equal to or less than an integer multiple of the length of the horizontal shielding member.

The length of the horizontal shield member may be equal to or less than a quarter of the array spacing of the antenna module array in the first direction.

The array spacing of the multiples of the horizontal shielding member may be at most twice the length of the horizontal shielding member.

The unit partitions may each include two vertical shielding members which have one ends connected to the base substrate and other ends connected to both ends of the horizontal shielding member, respectively.

The antenna device may further include second shield walls disposed on the antenna module string at both outer sides respectively, distally in the first direction, the second shield walls being formed by a plurality of unit partitions arranged in the second direction and spaced apart from each other, wherein the unit partitions of the second shield wall each include a horizontal shielding member spaced apart from a reflector by a second clearance height which is lower than the first clearance height.

The vertical shield members may have other ends, further including connection terminals formed to connect each of the unit partitions to the base substrate.

The connection terminals may each include a pin member inserted through the base substrate.

The connection terminals may each include a lead member extending in parallel with the base substrate, and the lead member may be configured to be soldered onto the base substrate.

The first shield wall may be formed by unit partitions that are composed of a printed circuit board erected on the base substrate and a conductive pattern formed on the printed circuit board.

Advantageous Effects

As described above, the present disclosure provides a shield wall formed between multiple dual-polarized antennas by arranging a plurality of staple-shaped unit partitions to mount a higher density of antenna modules with ease, thereby realizing a desirable antenna structure which is compact and lightweight, shielding against frequency interference.

BRIEF DESCRIPTION OF THE DRAWINGS

FIGS. 1A and 2B are conceptual diagrams of a conventional massive MIMO dual-polarized antenna having shield walls on four sides.

DETAILED DESCRIPTION

Figure 1A:
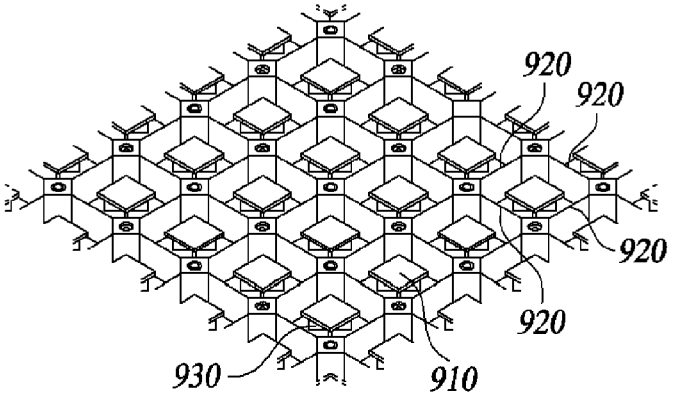

Hereinafter, some embodiments of the present disclosure will be described in detail with reference to the accompanying drawings. In the following description, like reference numerals designate like elements, although the elements are shown in different drawings. Further, in the following description of some embodiments, a detailed description of known functions and configurations incorporated therein will be omitted for the purpose of clarity and for brevity.

Additionally, various terms such as first, second, A, B, (a), (b), etc., may be used solely to differentiate one component from the other but not to imply or suggest the substances, order, or sequence of the components. Throughout this specification, when a part "includes" or "comprises" a component, the part is meant to further include other components, not to exclude thereof unless specifically stated to the contrary. The terms such as "unit," "module," and the like refer to one or more units for processing at least one function or operation, which may be implemented by hardware, software, or a combination thereof.

FIGS. 1A and 2B are conceptual diagrams of a conventional massive MIMO dual-polarized antenna having shield walls on four sides.

In general, a dual-polarized antenna includes antenna patches 910, a base substrate including a feed line 930 and a reflector, and shield walls 920. Of various shapes in use, the most common type of antennas for wireless communications apparatus is an X-POL (dual polarization) antenna having rectangular antenna patches and diagonally arranged poles oriented at an angle of +45 or −45. Such an X-POL antenna arrangement allows twice more antennas to be integrated into the same space as compared to a V-POL (single polarization) antenna to realize a large number of antennas in a smaller dimension. Such an antenna patch needs a predetermined interval to be secured between an adjacent patch to minimize their frequency interference. However, taking into account the mobile communication frequency band inhibits narrowing the interval of patches, which puts a limitation on reducing the size of the base station antenna.

Figure 1B:
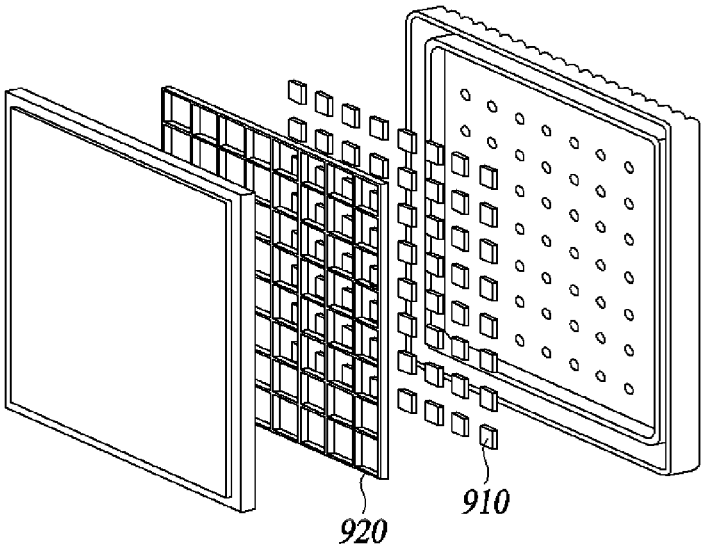

As shown in FIGS. 1A and 1B, the antenna patches 910 are provided with and surrounded by the shield walls 920, thereby reducing the array spacing between the antenna patches 910 and reducing their frequency interference while allowing 3-dimensional beamforming to be effectively performed by the base station antenna. However, this type of shield walls 920 disadvantageously increases the weight and manufacturing costs substantially.

The base substrate 310 may be a structure including a reflector, serve as a provider of grounding of the antenna circuit, and as a reflective surface. The rear radiation of the dual-polarized antenna is reflected in the main radiation direction, thereby improving the beam efficiency of the dual-polarized antenna. The antenna module 110 described below is supposed to include the antenna patches 910 and a feed line for supplying an RF signal to the antenna patches 910.

Figure 2:
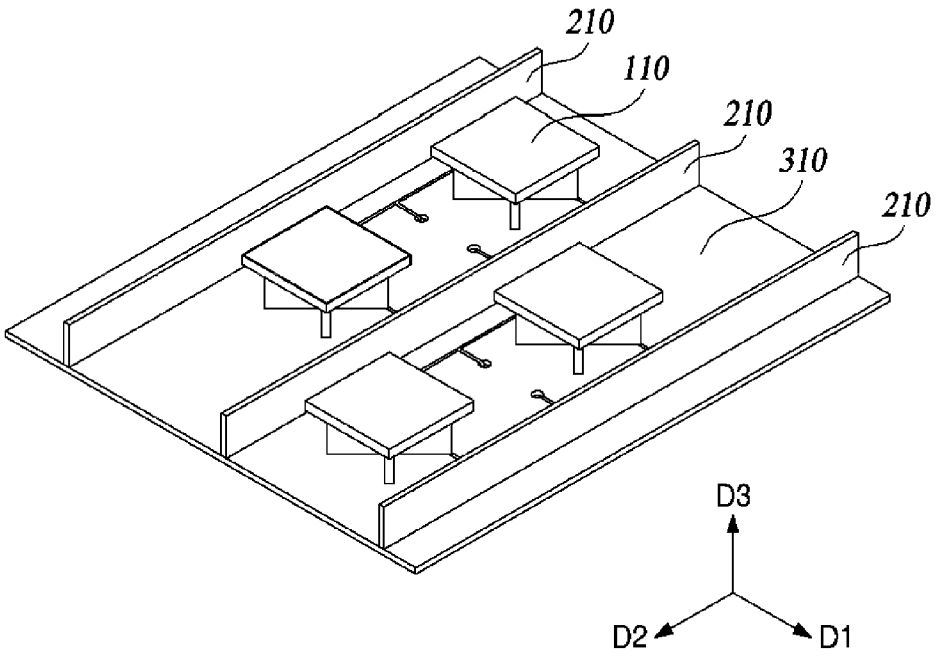
FIG. 2 is a conceptual diagram of a first comparative example in which vertical shield walls are disposed of in a massive MIMO dual-polarized antenna.

FIG. 2 is a conceptual diagram of a first comparative example in which vertical shield walls are disposed of in a massive MIMO dual-polarized antenna.

To reduce the weight and costs of manufacturing, a first comparative example by a conventional approach may be considered, in which shield walls 210 are installed only in one direction, i.e., longitudinal direction (a second direction D2) as shown in FIG. 2. However, the first comparative example is configured to provide each antenna module 110 with peripheral portions that are incompletely symmetrical both in a first direction D1 and second direction D2, resulting in an improved CO-POL isolation characteristic, but a degraded X-POL isolation characteristic.

Figure 3:
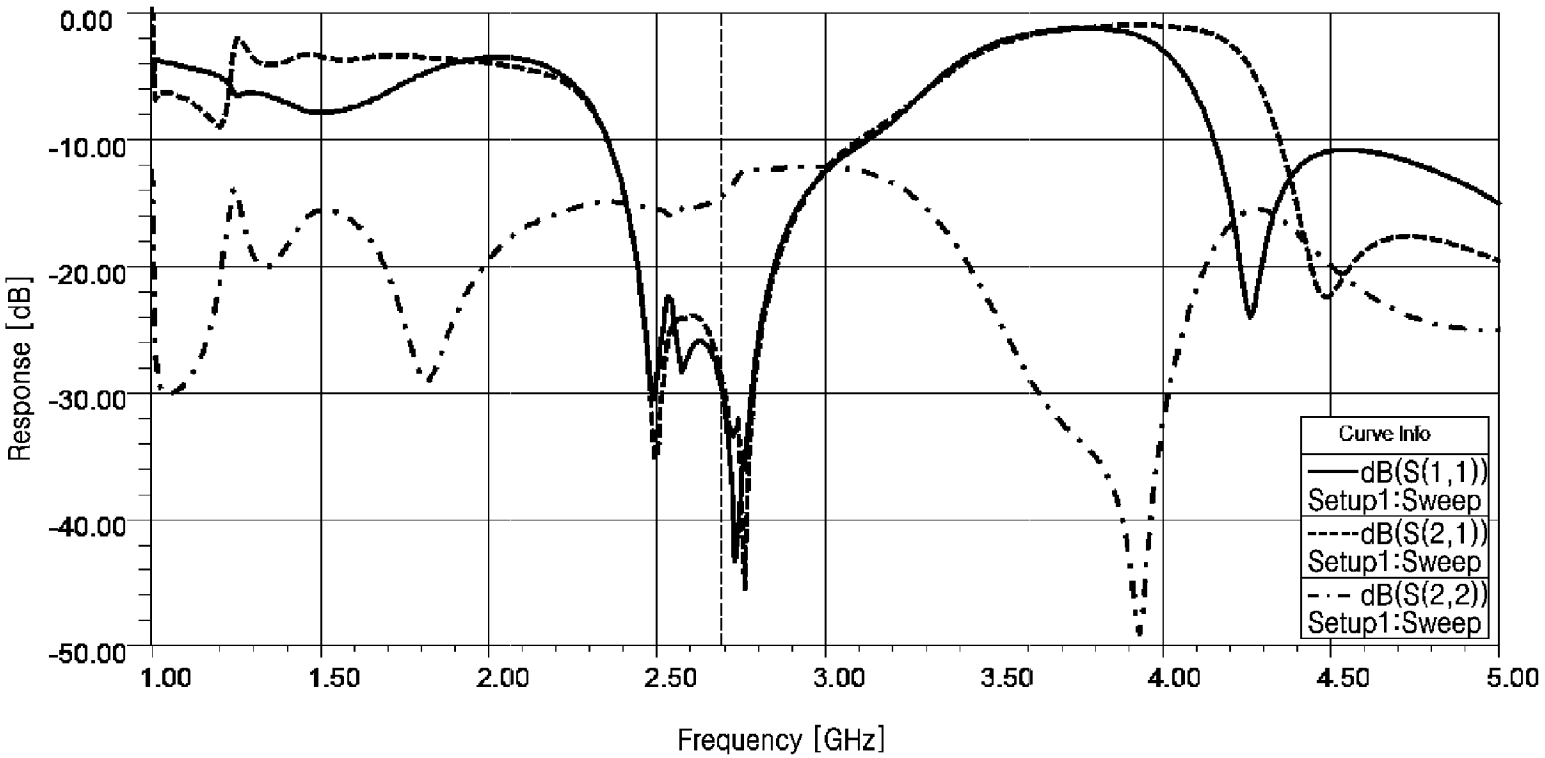
FIG. 3 is a graph of the X-POL isolation characteristics of the first comparative example by computational simulation.

FIG. 3 is a graph of the X-POL isolation characteristics of the first comparative example by computational simulation.

Figure 4:
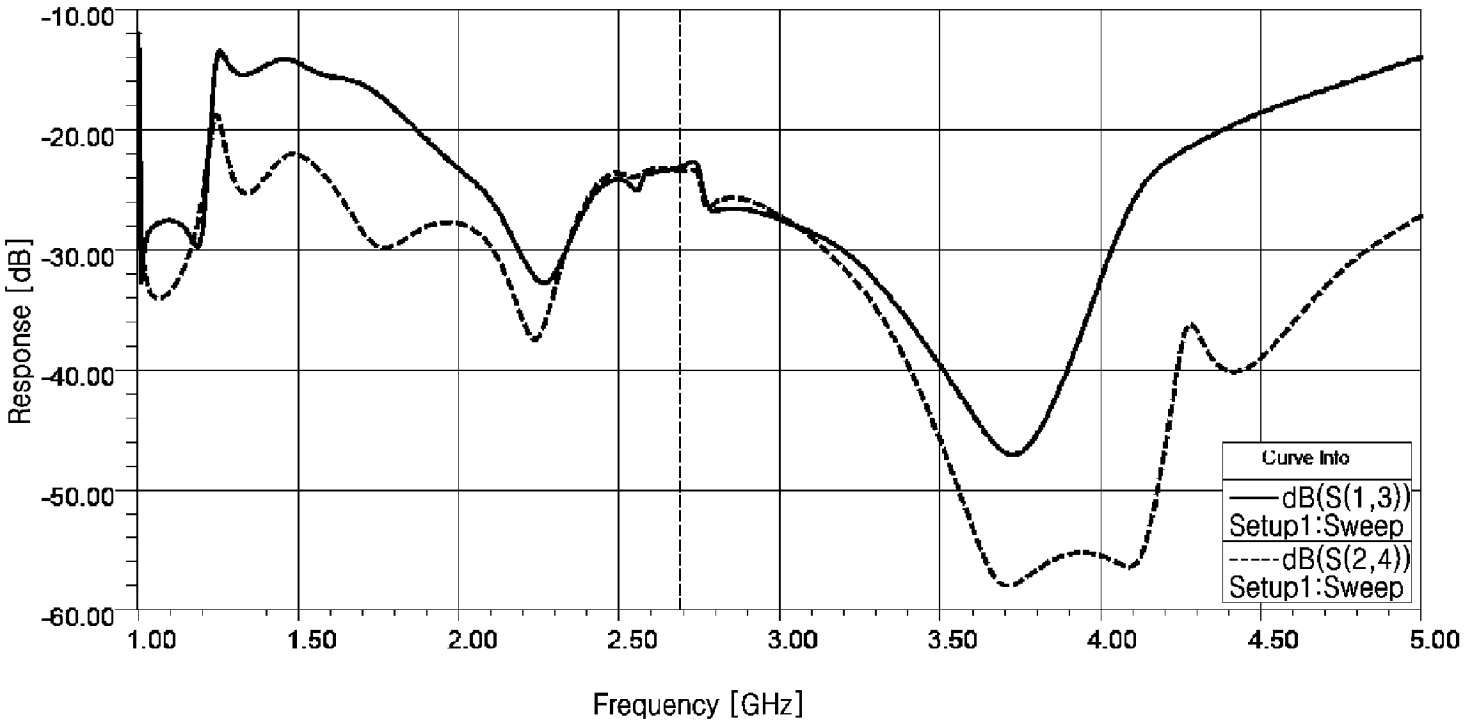
FIG. 4 is a graph of the CO-POL isolation characteristics of the first comparative example by computational simulation.

FIG. 4 is a graph of the CO-POL isolation characteristics of the first comparative example by computational simulation.

A typical massive MIMO antenna requires the X-POL and CO-POL isolation characteristics to have a 20 dB or more shieling performance. FIG. 4 shows that the CO-POL isolation characteristics are superior as being −23.1 dB for S1,2 and −23.6 dB for S2,4, while FIG. 3 shows that X-POL isolation is inferior by S2,1 being −14.5 dB. This exhibits that radio waves are reflected by the shield walls 210 between the antenna modules 110 neighboring in first direction D1 in which the shield wall 210 is not installed so that the radio waves interfere with each other, resulting in the degradation of characteristics.

Figure 5:
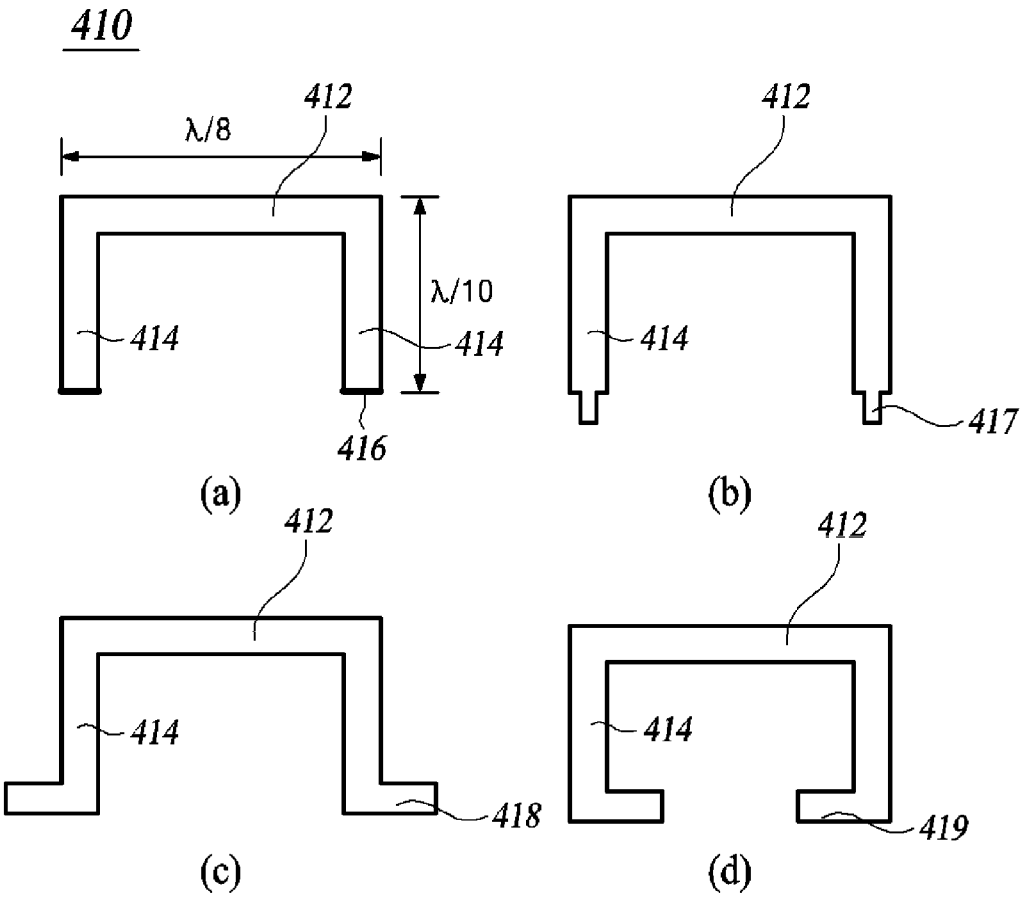
FIG. 5 is schematic views of unit partitions of a staple shape constituting a shield wall according to at least one embodiment of the present disclosure.

FIG. 5 is schematic views of unit partitions of a staple shape constituting a shield wall according to at least one embodiment of the present disclosure.

Figure 6:
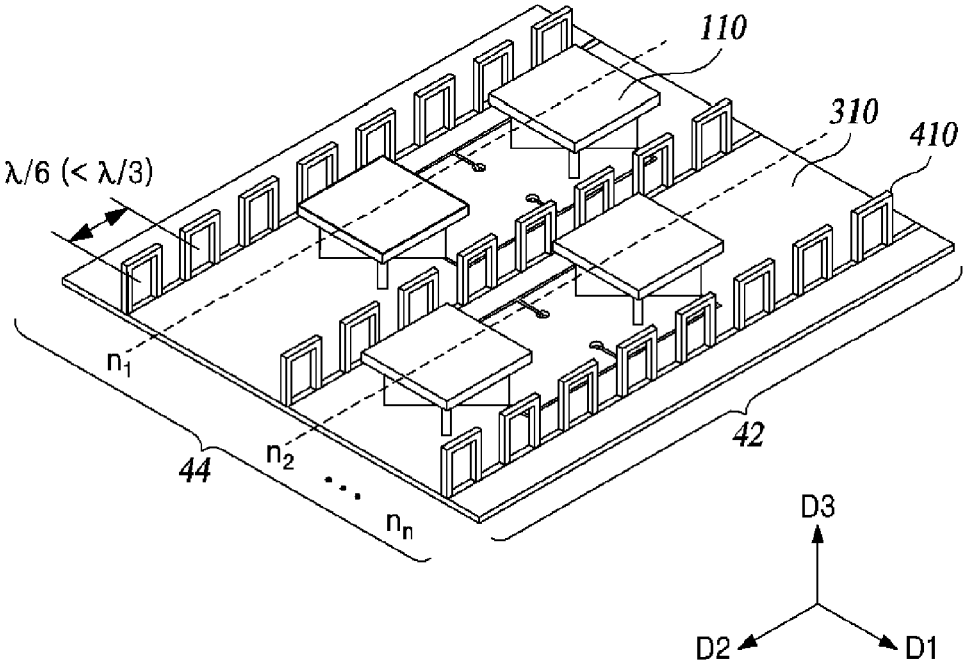
FIG. 6 is a conceptual diagram of shield walls arranged on both sides of dual-polarized antennas arrayed in a longitudinal direction according to at least one embodiment of the present disclosure.

FIG. 6 is a conceptual diagram of shield walls arranged on both sides of dual-polarized antennas arrayed in a longitudinal direction according to at least one embodiment of the present disclosure.

In describing the present disclosure, the shield wall 42 of FIG. 6 may be referred to as the first shield wall 42 to distinguish the same from a second shield wall 43, which will be described below.

As shown in FIG. 5 at (a), at least one embodiment of the present disclosure provides a unit partition 410 of a staple shape, and multiples of the unit partition 410 constitute the shield wall 42 for which the unit partitions 410 are aligned in rows longitudinally of the shield wall 42. The unit partition 410 includes a horizontal shielding member 412 that is equivalent to a crown on top and two vertical shielding members 414 that extend from both ends of the horizontal shielding member 412 and are connected to a plate-type base substrate 310. The base substrate 310 and the vertical shield members 414 include connection terminals 416 to facilitate surface mounting, soldering, and the like.

In short, each shield wall 42 has an alignment of multiple component unit partitions 410, each featuring the horizontal shielding member 412 that is disposed flush with the antenna modules 110 and further having the vertical shielding members 414, wherein the horizontal shielding member 412 and the vertical shielding members 414 are made of a wire bent into the unit partition 410 which is simple and easy to surface-mount.

The unit partition 410 may further take the shapes of FIG. 5, as shown at (b) through (d), including connection terminals 417, 418, and 419 respectively formed to be mounted on the base substrate 310 to firmly support the unit partition 410 to withstand external vibration. FIG. 5 shows at (b) the connection terminals 417 incorporated in the form of an insertion pin, which is adapted to be inserted in conforming through holes that are formed in the base substrate 310 to fixedly connect the unit partition 410 to the base substrate 310 by a conventional method such as soldering. FIG. 5 shows at (c) and (d) the connecting terminal portions 418 and 419 respectively formed in consideration of the surface mounting, bent inward or outward at the end portions of the unit partition 410 and extending therefrom, taking advantage of the typical contour of lead terminals of surface-mount components. The connection terminals 418 and 429 may be connected by soldering to pad-type terminals (not shown) formed on the base substrate 310. These embodiments are merely illustrative and are not intended to limit the scope of the present disclosure, which may be embodied in various other forms as well.

The array spacing between the unit partitions 410, the length of the horizontal shielding member 412, and the height of the vertical shielding member 414 may factor into determining the performance of the shield wall 42 according to at least one embodiment of the present disclosure, that is, the performance of reducing mutual interference between the antenna modules 110 due to the radio wave reflected by the unit partitions 410. In at least one embodiment, the height of the vertical shield member 414 is equivalent to the elevation of the horizontal shielding member 412 from above the base substrate 310 as a reference plane.

Amounting to the speed of light ($3\times10^8$ m/s), the speed of electromagnetic waves equals the product of wavelength and frequency. Here, the wavelength of 2.5 GHz, which is the band of the mobile communication frequency, is calculated to be 120 mm. The optimum shield wall design factor values according to at least one embodiment of the present disclosure are as follows.

The length of the horizontal shielding member 412 of the unit partition 410 is λ/8 and is preferably equal to one-eighth of the wavelength of the frequency in use, which corresponds to 15 mm for the frequency of 2.5 GHz. In at least one embodiment, the antenna module 110 has an array spacing that has been reduced in first direction D1 than in the conventional case, and the length of the horizontal shielding member 412 in at least one embodiment is so determined that can reduce mutual frequency interference between adjacent antenna modules 110. In particular, the antenna module 110 preferably has a length shorter than the array spacing in direction D1 between the antenna modules 110.

This is the case where the antenna modules 110 have an array spacing of λ/2 in second direction D2, and the length of the horizontal shielding member 412 is equivalent to a size of one-quarter of the array spacing between the antenna modules 110. In the arrangement of the unit partitions 410 according to at least one embodiment of the present disclosure, this may be interpreted that the array spacing of the horizontal shielding members 412 in second direction D2 preferably has an integer multiple of the length of the horizontal shielding member 412. Where the placement of the antenna modules 110 is different from the at least one embodiment, the array spacing of the horizontal shield members 412 may be optimized not to exceed the size determined by the conditions described above. The vertical shield member 414 preferably has a height referred to as a first clearance height that equals to λ/10 of the wavelength of the frequency in use, and that the distance between the horizontal shielding member 412 and the base substrate 310 is less than the length of the horizontal shielding member 412 and is equal to 12 mm for 2.5 GHz. The distance between the horizontal shielding member 412 and the base substrate 310 is 12 mm. The array spacing of the unit partitions 410 is preferably less than λ/3, and in at least one embodiment, it is designed to be λ/6 by which the unit partitions 410 are arranged. When considering modifications to the basic arrangement of the antenna modules 110, it is preferable that the array spacing between the unit partitions 410 is smaller than twice the length of the horizontal shielding member 412 to shield radio waves that can be transmitted through the shield walls 42. The numerical values associated with the size and number of the unit partitions 410 may be determined by the arrangement of the antenna modules 110 and the wavelength of the frequency they use, and the numerical values can be easily optimized by computer simulation.

Figure 7:
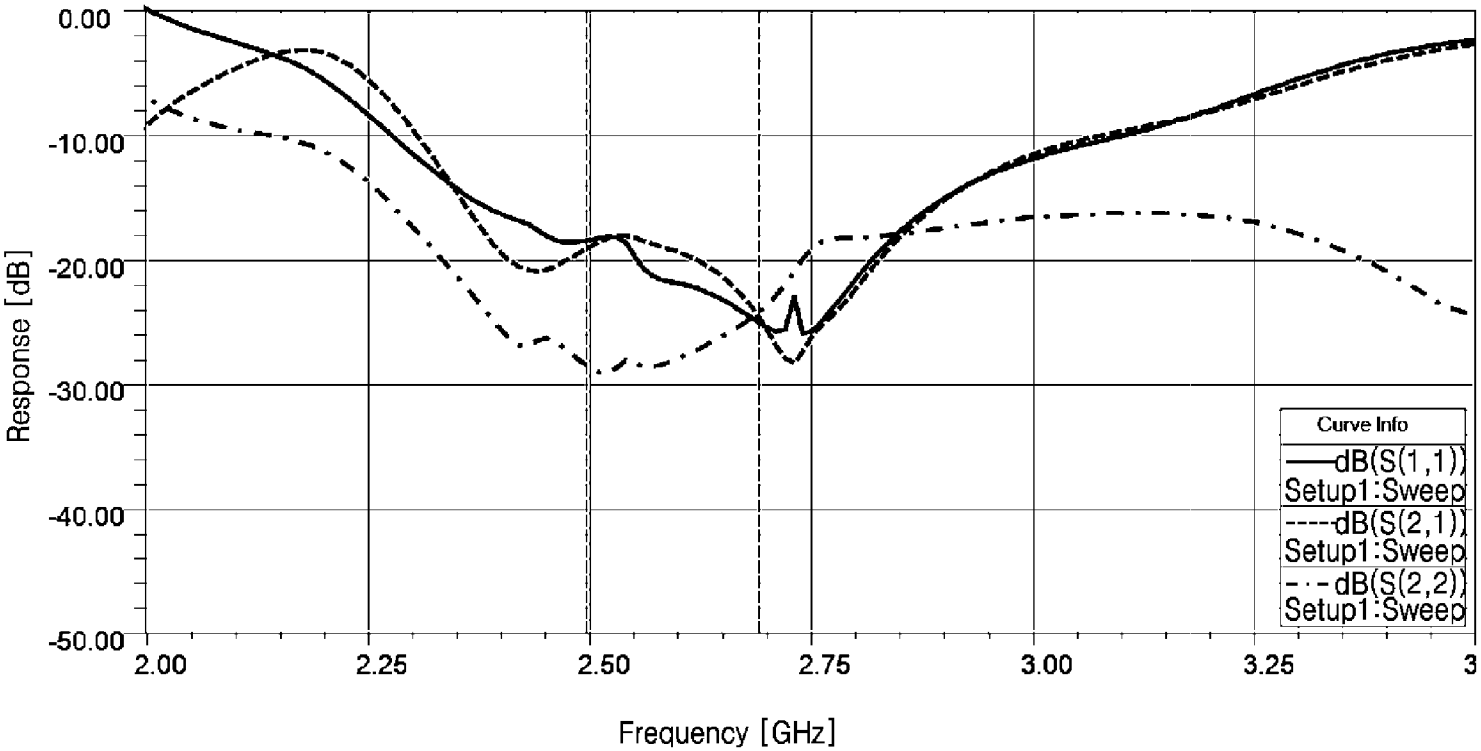
FIG. 7 is a graph by computational simulation of the X-POL isolation characteristics of shield walls designed according to at least one embodiment of the present disclosure.

FIG. 7 is a graph by computational simulation of the X-POL isolation characteristics of shield walls designed according to at least one embodiment of the present disclosure.

Figure 8:
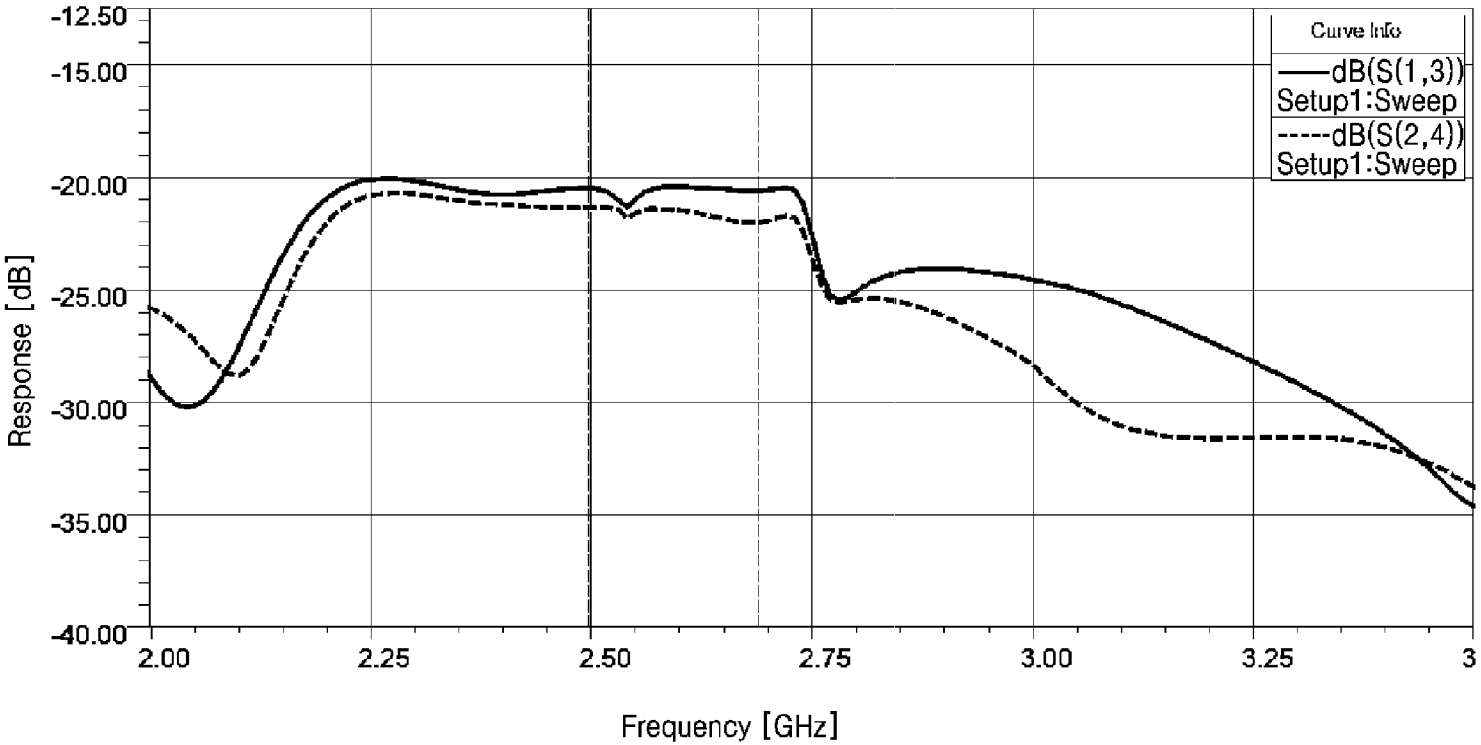
FIG. 8 is a graph by computational simulation of the CO-POL isolation characteristics of shield walls designed according to at least one embodiment of the present disclosure.

FIG. 8 is a graph by computational simulation of the CO-POL isolation characteristics of shield walls designed by at least one embodiment of the present disclosure.

As shown in FIGS. 7 and 8, the shield walls 42 according to at least one embodiment of the present disclosure have the X-POL isolation characteristics exhibiting −24 dB for S2,1 and the CO-POL isolation characteristics exhibiting −20.5 dB for S1,3 and −21.3 dB for S2,4 which satisfy both specifications, wherein the X-POL isolation exhibiting −24 dB signifies the very good performance of the shield walls.

Figure 9:
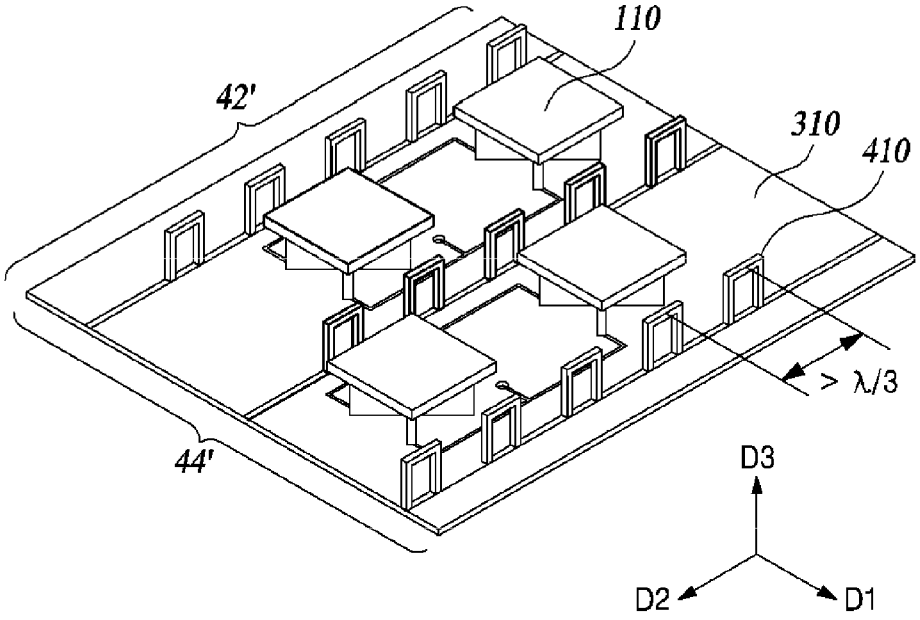
FIG. 9 is a schematic diagram of a second comparative example in which shield walls are arranged at an interval greater than one-third of a wavelength in use, according to at least one embodiment of the present disclosure.

FIG. 9 is a schematic diagram of a second comparative example in which shield walls are arranged at an interval greater than one-third of a wavelength in use, as opposed to at least one embodiment of the present disclosure.

Figure 10:
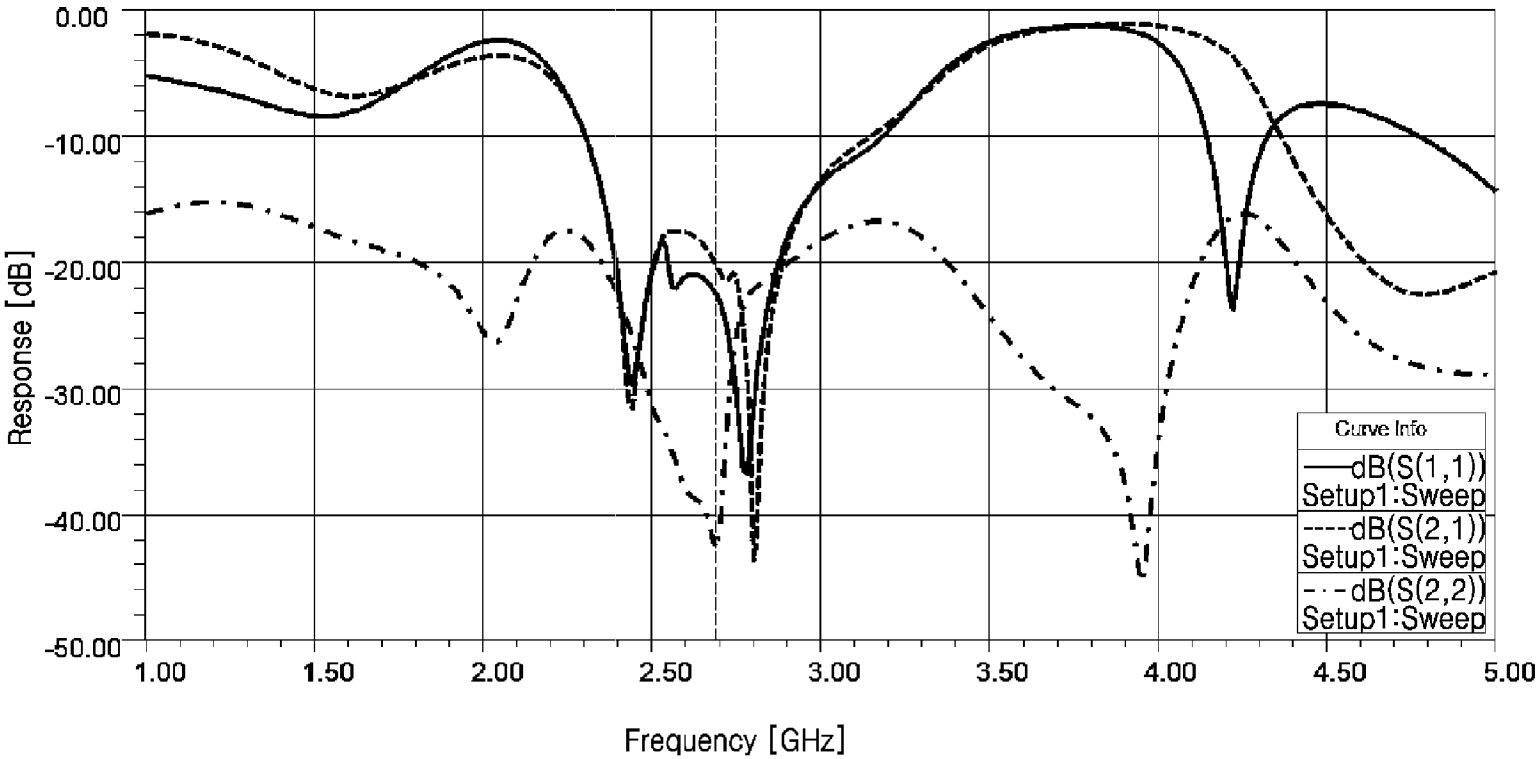
FIG. 10 is a graph of the X-POL isolation characteristics of the second comparative example by computational simulation.

FIG. 10 is a graph of the X-POL isolation characteristics of the second comparative example by computational simulation.

Figure 11:
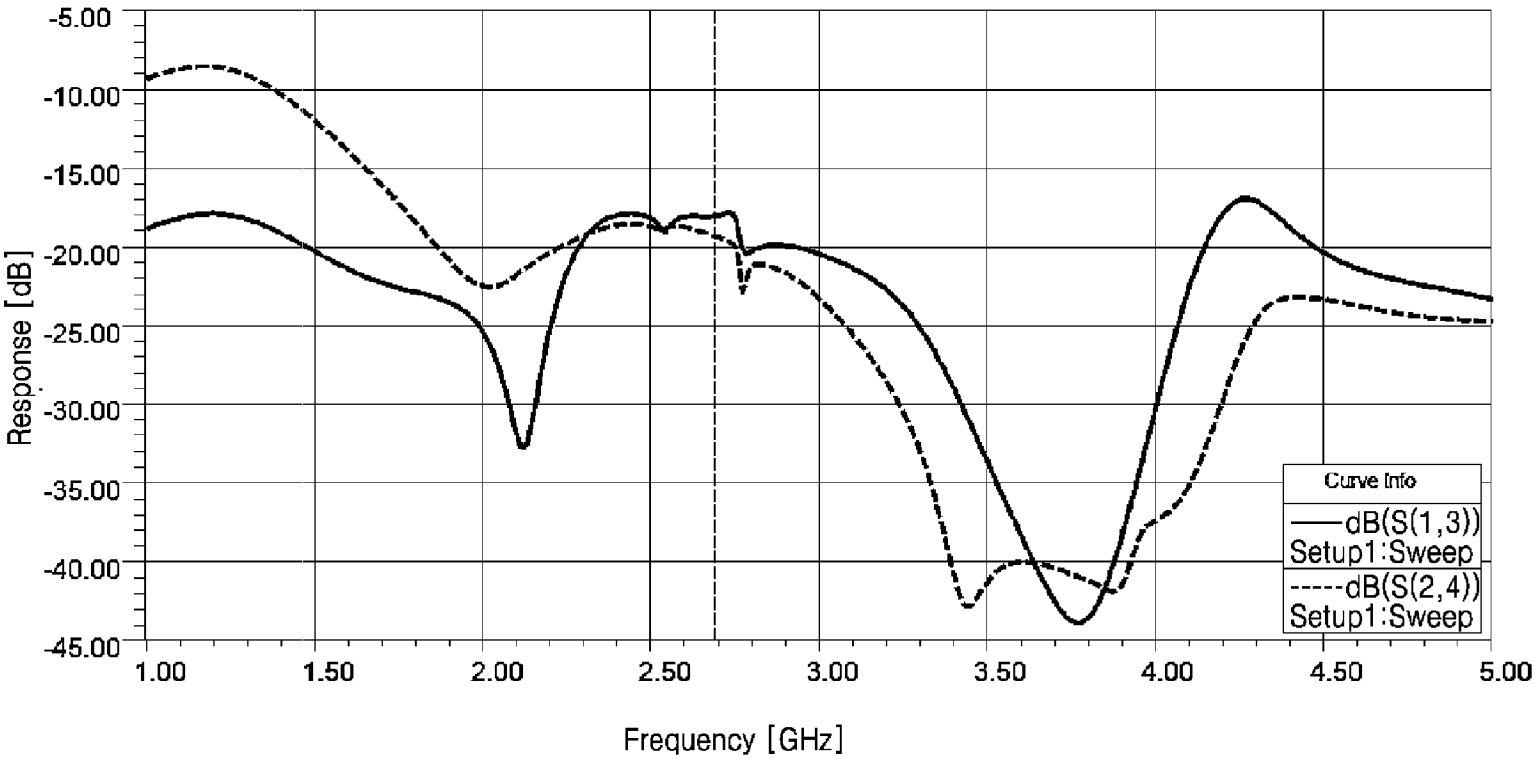
FIG. 11 is a graph of the CO-POL isolation characteristics of the second comparative example by computational simulation.

FIG. 11 is a graph of the CO-POL isolation characteristics of the second comparative example by computational simulation.

FIG. 9 is a second comparative example made from the design of FIG. 6 by just enlarging its array spacing by more than λ/3. As shown in FIGS. 10 and 11, the second comparative example has the X-POL isolation of excellence at −31.1 dB but the CO-POL isolation of the status quo exhibiting −18 dB for S1,3 and −18.7 dB for S2,4, failing to satisfy the typical minimum required shielding value of −20 dB and more.

Figure 12:
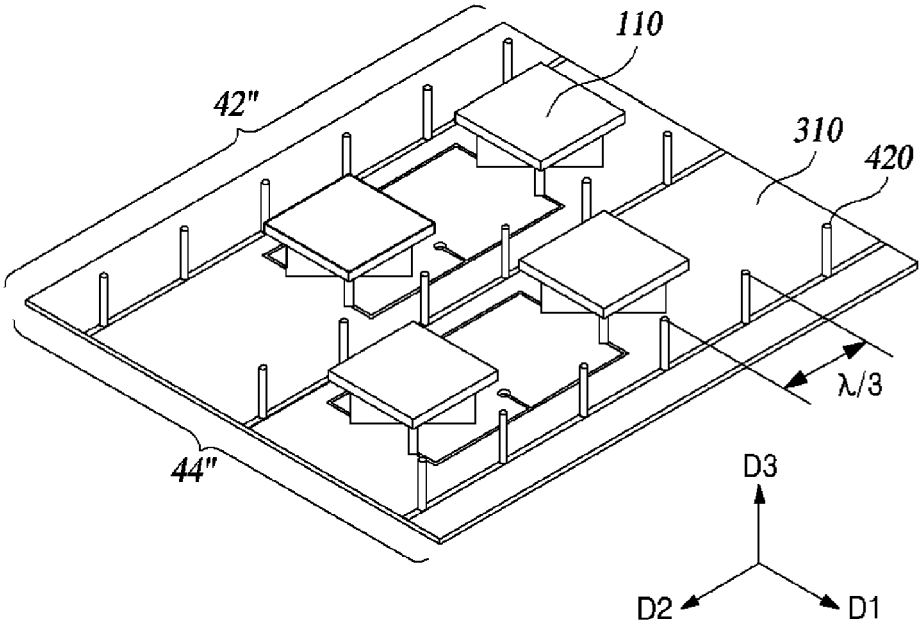
FIG. 12 is a schematic diagram of a third comparative example where unit partitions have no horizontal shielding member, according to at least one embodiment of the present disclosure.

FIG. 12 is a schematic diagram of a third comparative example where unit partitions have no horizontal shielding member as compared to the at least one embodiment of the present disclosure.

Figure 13:
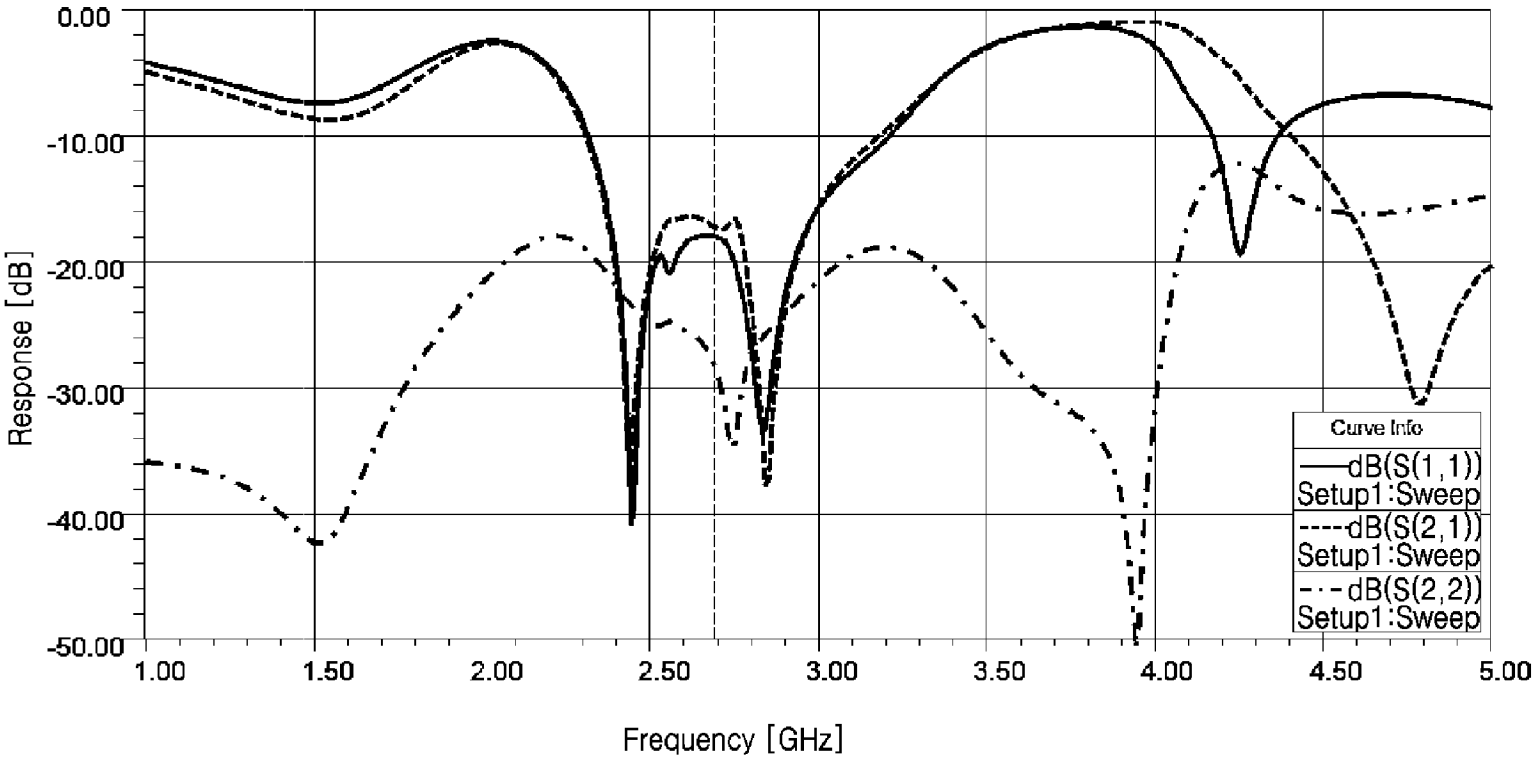
FIG. 13 is a graph of the X-POL isolation characteristics of the third comparative example by computational simulation.

FIG. 13 is a graph of the X-POL isolation characteristics of the third comparative example by computational simulation.

Figure 14:
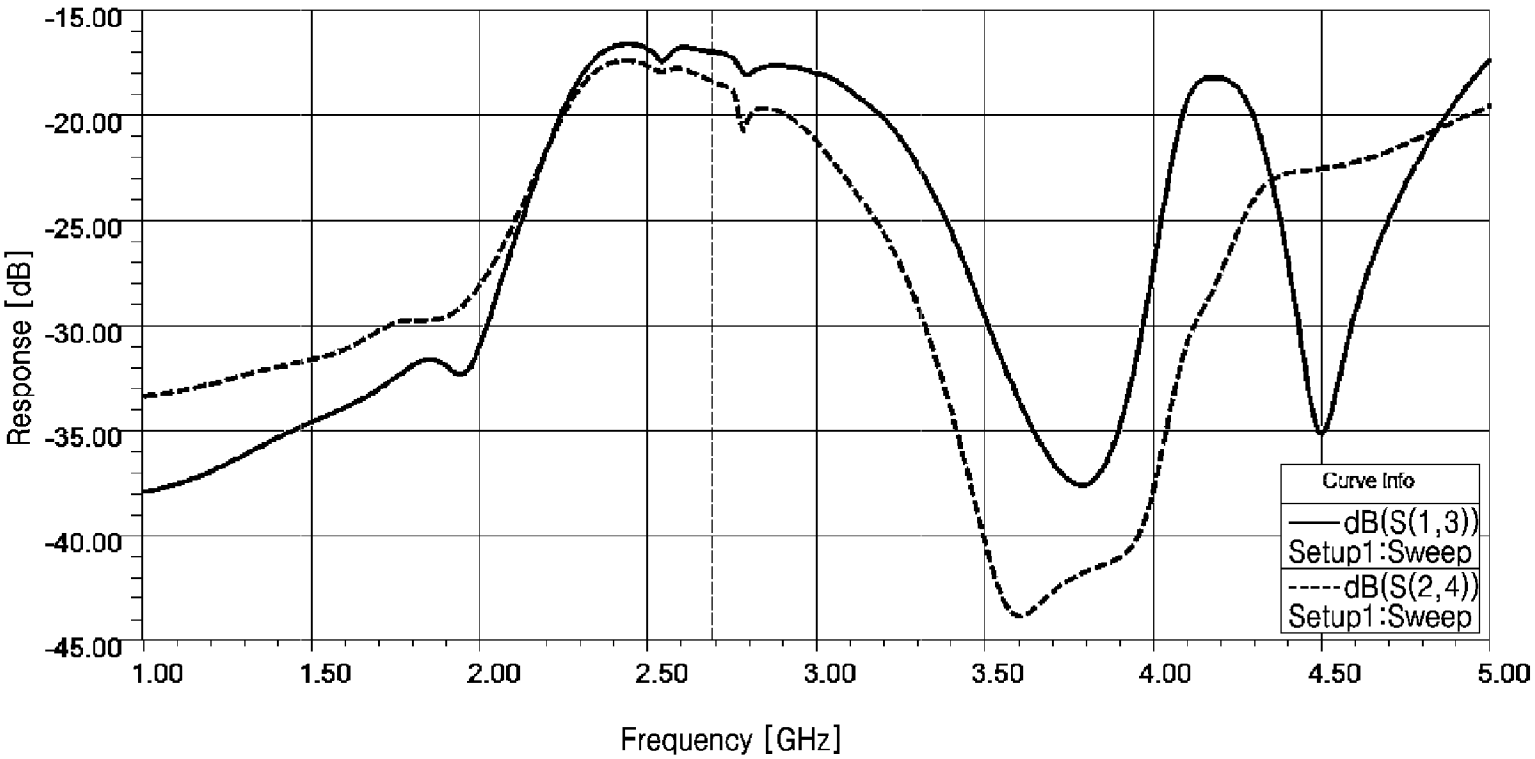
FIG. 14 is a graph of the CO-POL isolation characteristics of the third comparative example by computational simulation.

FIG. 14 is a graph of the CO-POL isolation characteristics of the third comparative example by computational simulation.

FIG. 12 assumes that the unit partitions 410 of the design of FIG. 6 have none of the horizontal shielding members 412 on top, leaving singular rods alone, and there is a technique known to use rods of this kind to improve the antenna property. However, the computational simulations, according to the third comparative example, present the X-POL isolation of −24.8 dB to ensure adequate performance but the CO-POL isolation exhibiting −18 dB for S1,3 and −17.6 dB for S2,4, failing to secure the necessary performance.

Therefore, when employed by the massive MIMO antenna, the shield wall 42 in which the unit partitions 410 are arranged according to at least one embodiment of the present disclosure may be designed to have the horizontal shielding member 412 at its best length, the vertical shielding member 414 at its best height and have a predetermined size or relatively smaller array spacing, which can satisfy both the X-POL and the CO-POL isolation characteristics.

Referring again to FIG. 2, the comparative case of the plain plate-like shield wall 210 being installed only in the longitudinal second direction D2 secures the CO-POL isolation performance but has a degraded X-POL isolation performance. On the other hand, in the second and third comparative examples of FIGS. 9 and 11, the array spacing greater than λ/3 between the unit partitions 410 and between the unit partitions 420 improves the X-POL isolation performance, but it can hardly secure the CO-POL isolation performance.

In at least one embodiment, the array spacing of the antenna modules 110 or the shield walls 42 in first direction D1, which is the transverse direction, is set to 0.5λ, the array spacing of the antenna modules 110 in second direction D2, which is the longitudinal direction, is set to 0.7λ, and the CO-POL isolation between the antenna modules 110 as disposed transversely generally depends on the transverse array spacing in first direction D1. However, considering the various related components and circuits mounted on the rear surface of the antenna along with the base station antenna structure and the like, the array spacing in the transverse direction, which is first direction D1, is more restrictive in design. The transverse distance between the elements of the antenna module 110 needs to be less than the wavelength λ of the frequency in use to prevent the generation of a grating lobe and to be larger than the λ/2 size to reduce the coupling between the elements so that the longitudinal distance is preferably to set close to the middle ground that is 0.7λ.

Where the array spacing is narrow in the horizontal direction, i.e., first direction D1, X-POL isolation is degraded by installing the shield walls 210 alone longitudinally in second direction D2 as shown in FIG. 2 rather than installing the shield walls 920 to surround the respective antenna modules 110. On the other hand, with the wide array spacing between the unit partitions 410 or 420, as shown in FIG. 9 or FIG. 11, CO-POL isolation is degraded.

Although the unit partition 410 according to at least one embodiment of the present disclosure has the form of a staple having a rectangular shape with one side removed for the sake of convenience of manufacture, various modified forms from a staple form, such as, among others, a 'π' shape or a partition having an inwardly or outwardly inclined leg.

According to at least one embodiment of the present disclosure, the unit partition 410 is included in a plane to which the shield wall 42 belongs and can shield the frequency interference between the neighboring antenna modules 110 with the horizontal shielding member 412 or the vertical shielding member 414 not being necessarily straight. The horizontal shielding member 412 of the unit partition 410 in at least one embodiment may not be straight as far as the projected image of the horizontal shielding member 412 on a first plane parallel to the antenna module 10 is straight. When making the horizontal shielding member 412 non-straight, the distance between both ends of the horizontal shielding member 412 and the array spacing between the unit partitions 410 may be designed through an optimization process using a computer simulation or other methods.

Besides, although not shown, unit partitions in the form of hollow sheets should also be construed to be included within the scope of the present disclosure. It is to be understood that the unit partition in the form of a sheet with a hollow interior also has a shielding effect similar to the shape formed by a linear member in the form of a wire, and such embodiments are also intended to be included within the scope of the present disclosure. In this case, the width, the height, and the internal hollow dimension of the sheet based on the frequency wavelength used can be provided with optimized numerical values of design variables through computational simulation as with the linear member in the staple form.

According to the present disclosure, the shield wall 42, which has the unit partitions 410 arranged in the longitudinal second direction D2, is structured as bent wire pieces, resulting in just a little gain in weight of the entire shield wall 44 but an advantageous gain in production and installation. The very lightweight unit partition 410 obviates the need for the base substrate 310 to be formed with vias for assembly so that the unit partition 410 can be firmly attached to the base substrate 310 by SMD soldering alone. A person skilled in the art will be able to use various methods of improving the coupling strength between the unit partition 410 and the base substrate 310 after the surface mounting, such as by further bending the end of the vertical shield member 414 of the unit partition 410 so that the bent end extends in parallel to the base substrate 310.

Figure 15:
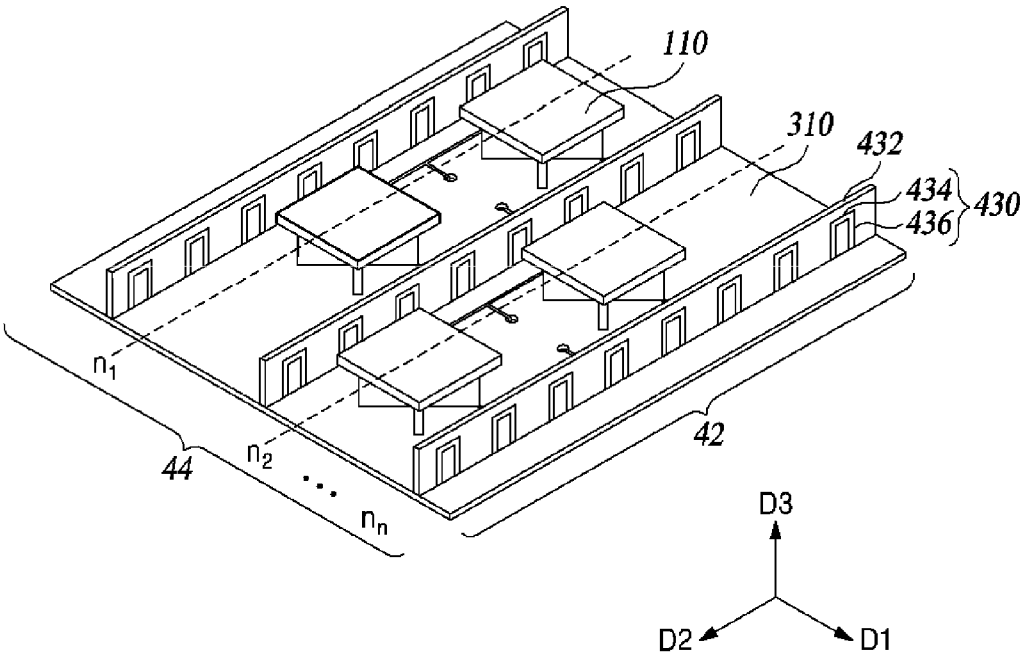
FIG. 15 is a schematic diagram of shield walls of unit partitions formed as a conductive pattern on a printed circuit board, according to yet another embodiment of the present disclosure.

FIG. 15 is a schematic diagram of shield walls of unit partitions formed as a conductive pattern on a printed circuit board, according to yet another embodiment of the present disclosure.

FIG. 15 illustrates an embodiment in which the unit partitions 410, according to the at least one embodiment, is implemented as conductive pattern units 430 on a printed circuit board 432. The printed circuit board 432 is formed of a dielectric material substrate, and the unit partitions 410 in the at least one embodiment are herein transformed into the equivalent shapes arranged in a conductive pattern in second direction D2 at regular intervals on the printed circuit board 432. Provided equivalent to the unit partitions 410, the conductive pattern units 430 each include a top segment 434 and link segments 436. Top segments 434 are formed to be straight, arranged side by side in second direction D2, and spaced apart from the base substrate 310. The link segments 436 are formed to electrically connect both ends of each top segment 434 with the base substrate 310. The top segment 434 is preferably arranged to have a length of λ/8 based on the frequency wavelength in use and have a clearance of λ/10 from the base substrate 310 based on the frequency wavelength in use. The array spacing between the conductive pattern units 430 arranged on the printed circuit board 432 is preferably less than λ/3, and the array spacing in at least one embodiment is λ/6.

By implementing the shield wall 42 with the conductive pattern units 430 mounted on the printed circuit board 432, manufacturing costs of the shield wall 42 can be reduced, mounting on the base substrate 310 can be very simple, and the shield wall 42 can be easily redesigned to have various types of conductive pattern units 430 conforming to various antenna devices.

In principle, a massive MIMO antenna, used as an external antenna in a wireless communication base station, is harshly exposed to temperature change, vibration, etc. so that it is preferably structured to be shock-proof. With the unit partition 410 according to at least one embodiment of the present disclosure, the quality and workability of the soldering process can be very high compared to the soldering of a member having a wide metal piece or copper foil layer which quickly absorbs and dissipates heat applied during soldering. Such improvement of the unit partition 410 is a very advantageous point for the massive MIMO antennas that need to be designed with mass production in mind.

Apart from the principal symmetry generally maintained along second direction D2 between the antenna modules 110 and the shield walls 42, the antenna device has edges 510 where symmetry is absent. In this case, unless sufficient ground areas are secured for the edges 510 of the base substrate 310, the frequency characteristics of the outermost antenna modules 110 may be degraded.

Figure 16:
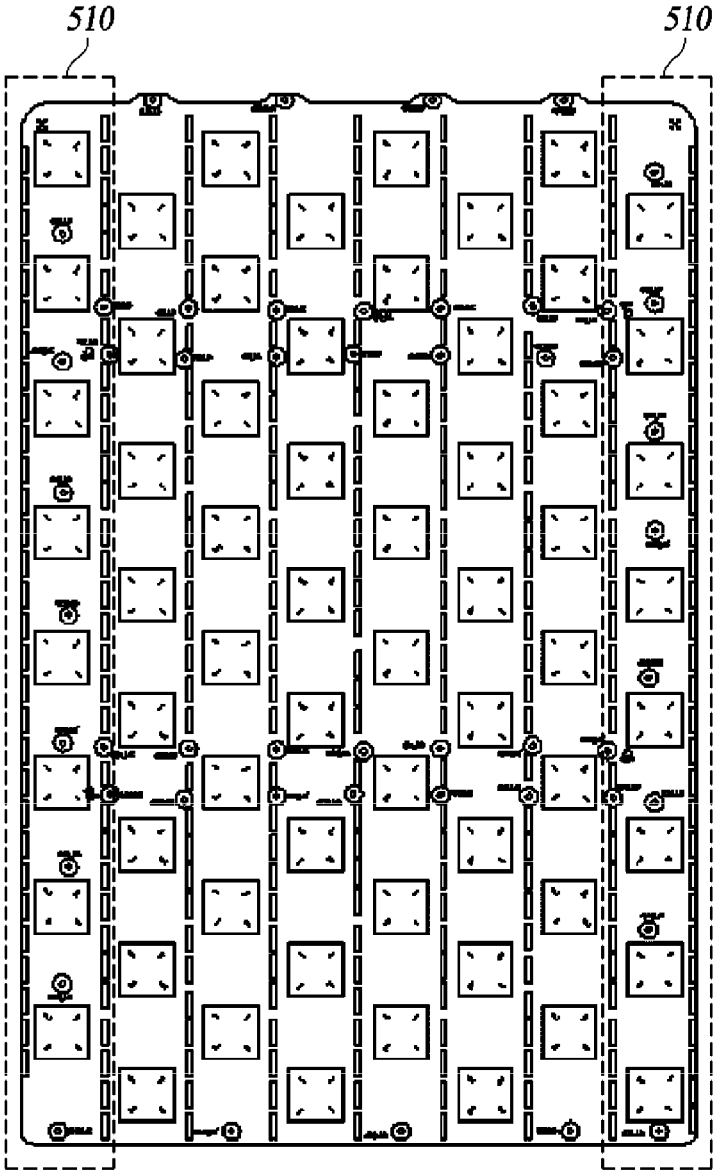
FIG. 16 is an overall plan view of an antenna device according to at least one embodiment of the present disclosure, illustrating asymmetry of shield walls disposed at outermost portions of the antenna device.

FIG. 16 is an overall plan view of an antenna device according to at least one embodiment of the present disclosure, illustrating asymmetry of shield walls disposed at outermost portions of the antenna device.

Although the ground areas of the edges 510 of the base substrate 310 are required to maintain the antenna characteristics, the ground area of each edge 510 of the base substrate 310 is preferably minimized for the sake of some saved dimension of the entire massive MIMO antenna since those areas do not take part in transmitting and receiving the actual radio frequency signal.

Figure 17:
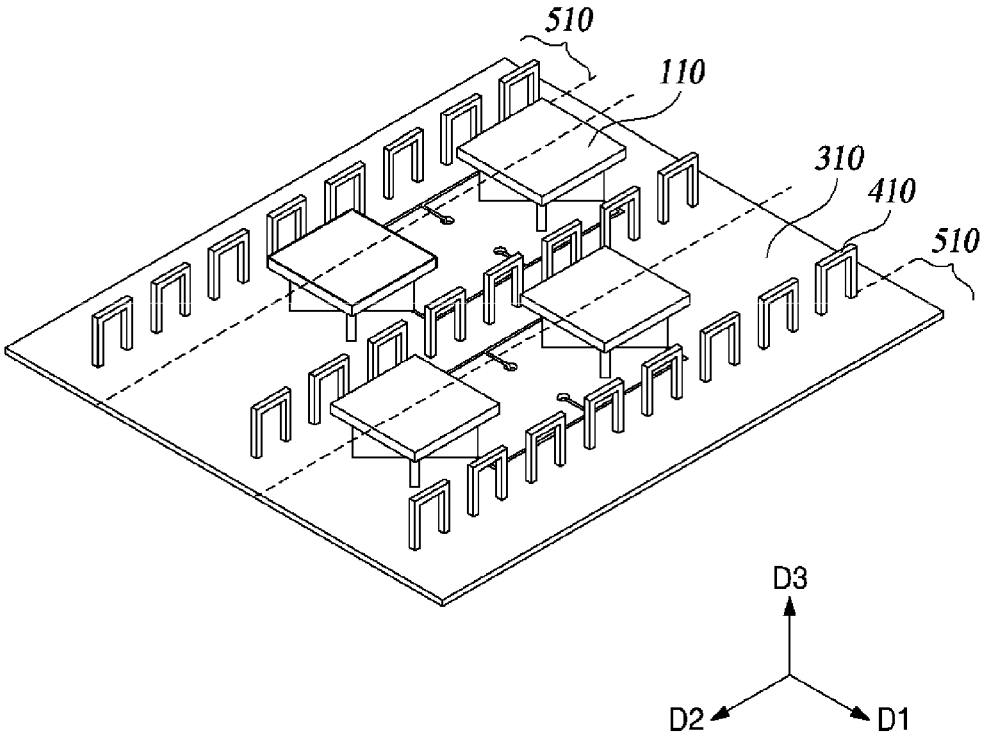
FIG. 17 is a perspective view of a fourth comparative embodiment which has sufficiently secured an outer ground of the outermost second shield walls of the antenna device according to at least one embodiment of the present disclosure.

FIG. 17 is a perspective view of a fourth comparative embodiment which has sufficiently secured an outer ground of the outermost second shield walls of the antenna device according to at least one embodiment of the present disclosure.

Figure 18:
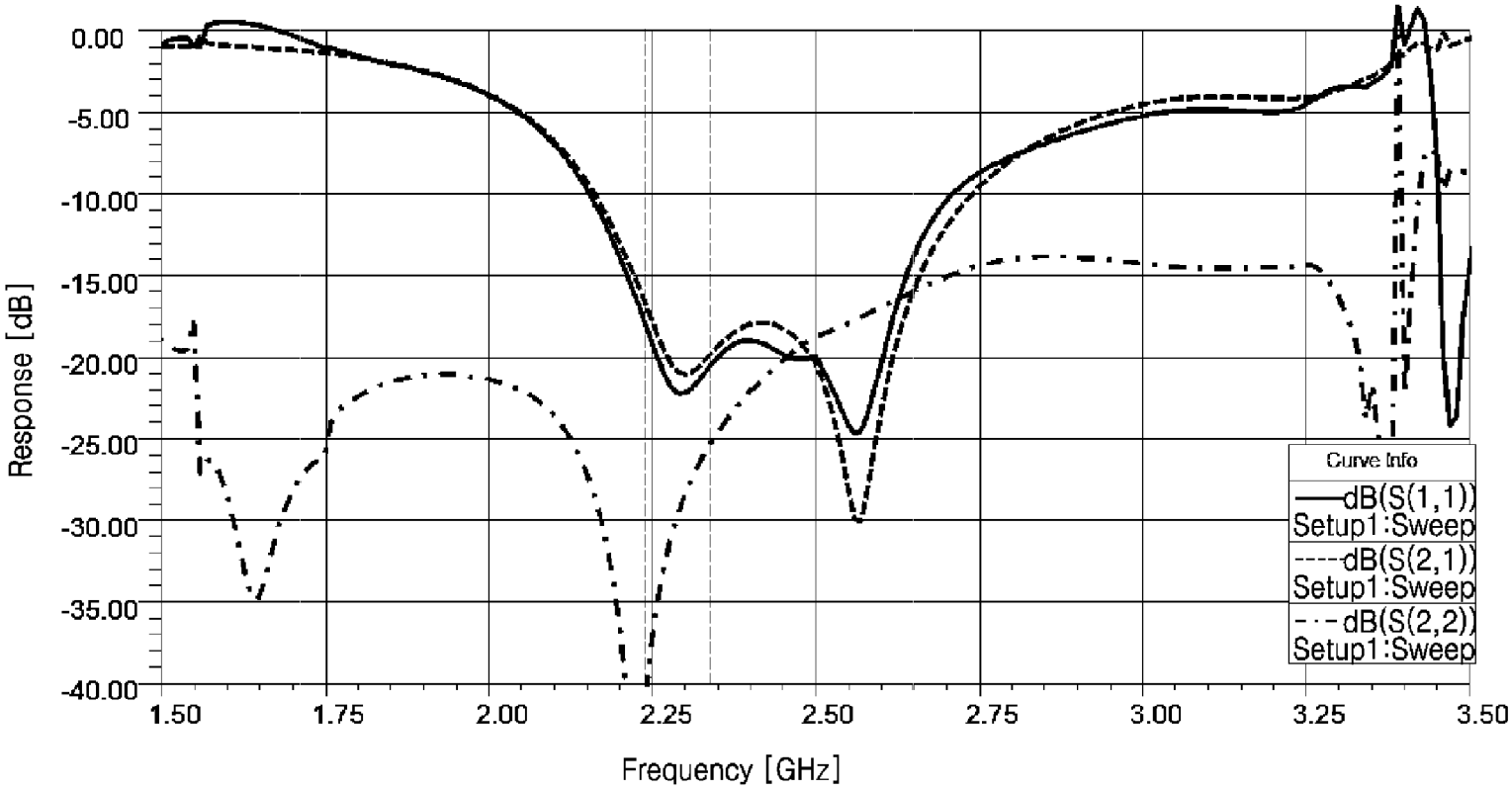
FIG. 18 is a graph of the X-POL isolation characteristics of the fourth comparative embodiment by computational simulation.

FIG. 18 is a graph of the X-POL isolation characteristics of the fourth comparative embodiment by computational simulation.

Figure 19:
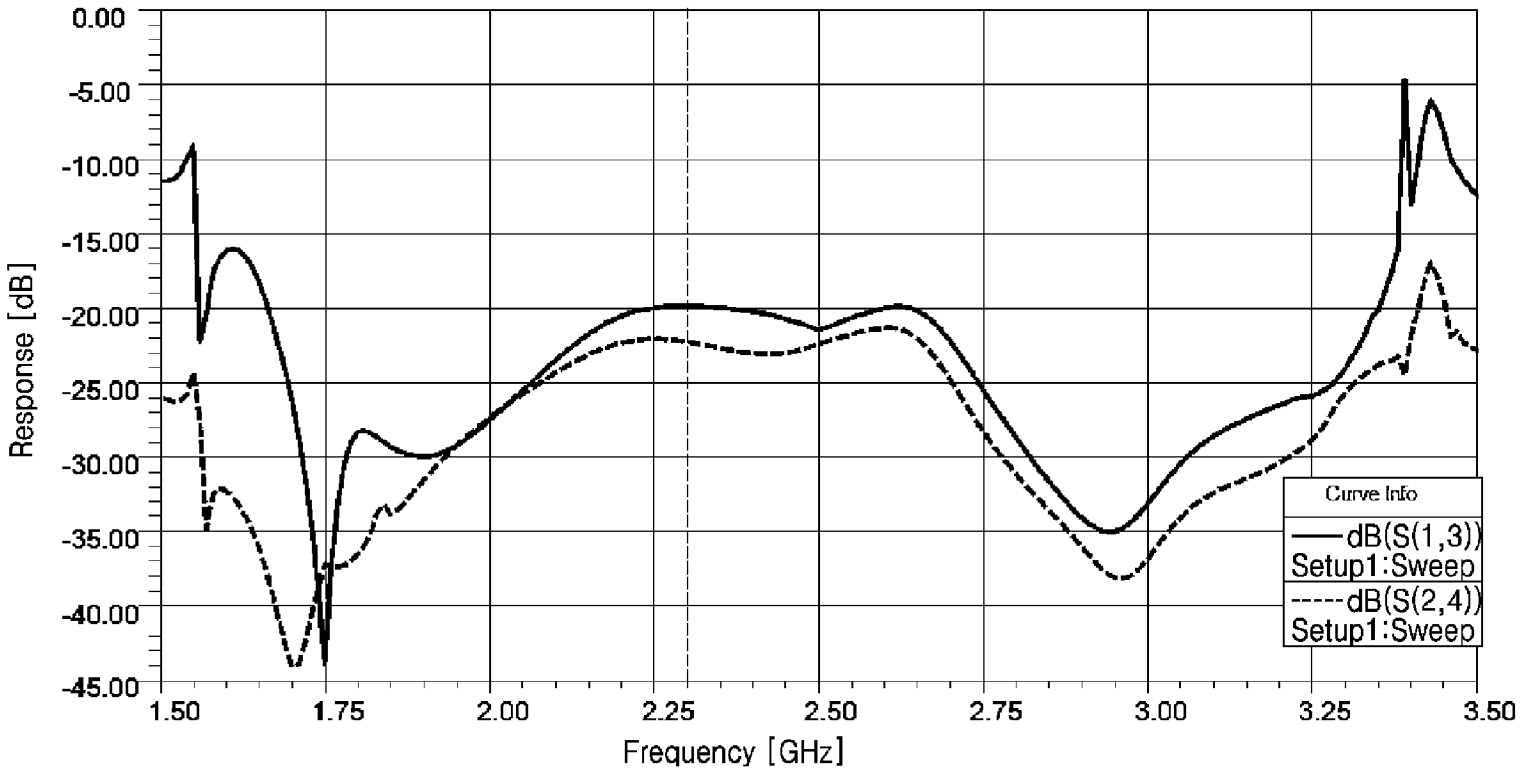
FIG. 19 is a graph of the CO-POL isolation characteristics of the fourth comparative embodiment by computational simulation.

FIG. 19 is a graph of the CO-POL isolation characteristics of the fourth comparative embodiment by computational simulation.

FIG. 17 illustrates the shield walls 42 when employing the unit partitions 410 of optimized values according to at least one embodiment of the present disclosure, wherein the ground areas of the edges 510 of the base substrate 310 are sufficiently secured. The simulation results of FIGS. 18 and 19 show that the CO-POL isolation characteristic has −19.8 dB, and the X-POL isolation has −25 dB, indicating no significant degradation in the characteristics of the antenna modules 110 located at the outer sides.

Figure 20:
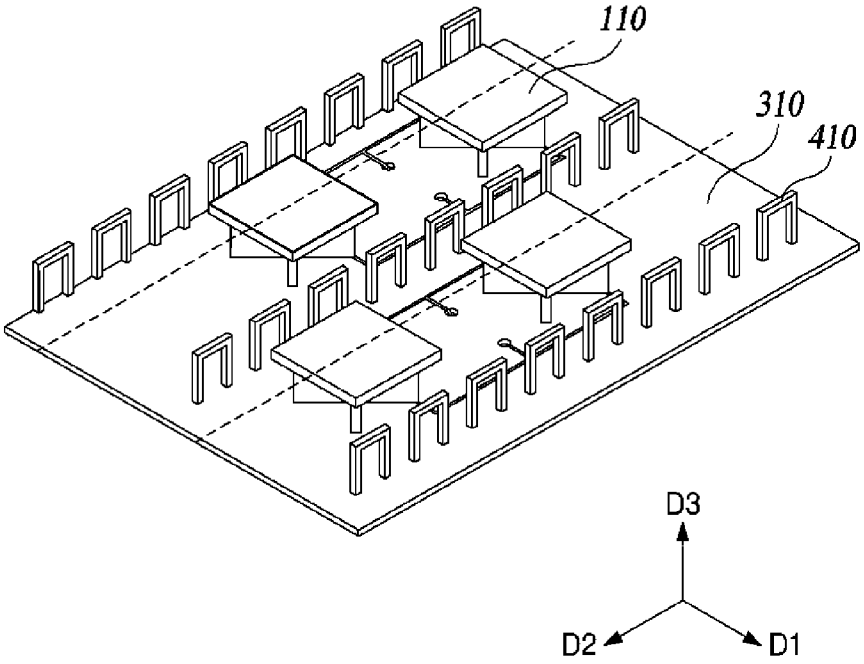
FIG. 20 is a perspective view of a fifth comparative example showing a narrow outer ground of the outermost second shield walls of the antenna device, according to at least one embodiment of the present disclosure.

FIG. 20 is a perspective view of a fifth comparative example showing a narrow outer ground of the outermost second shield walls of the antenna device, as opposed to the at least one embodiment of the present disclosure.

Figure 21:
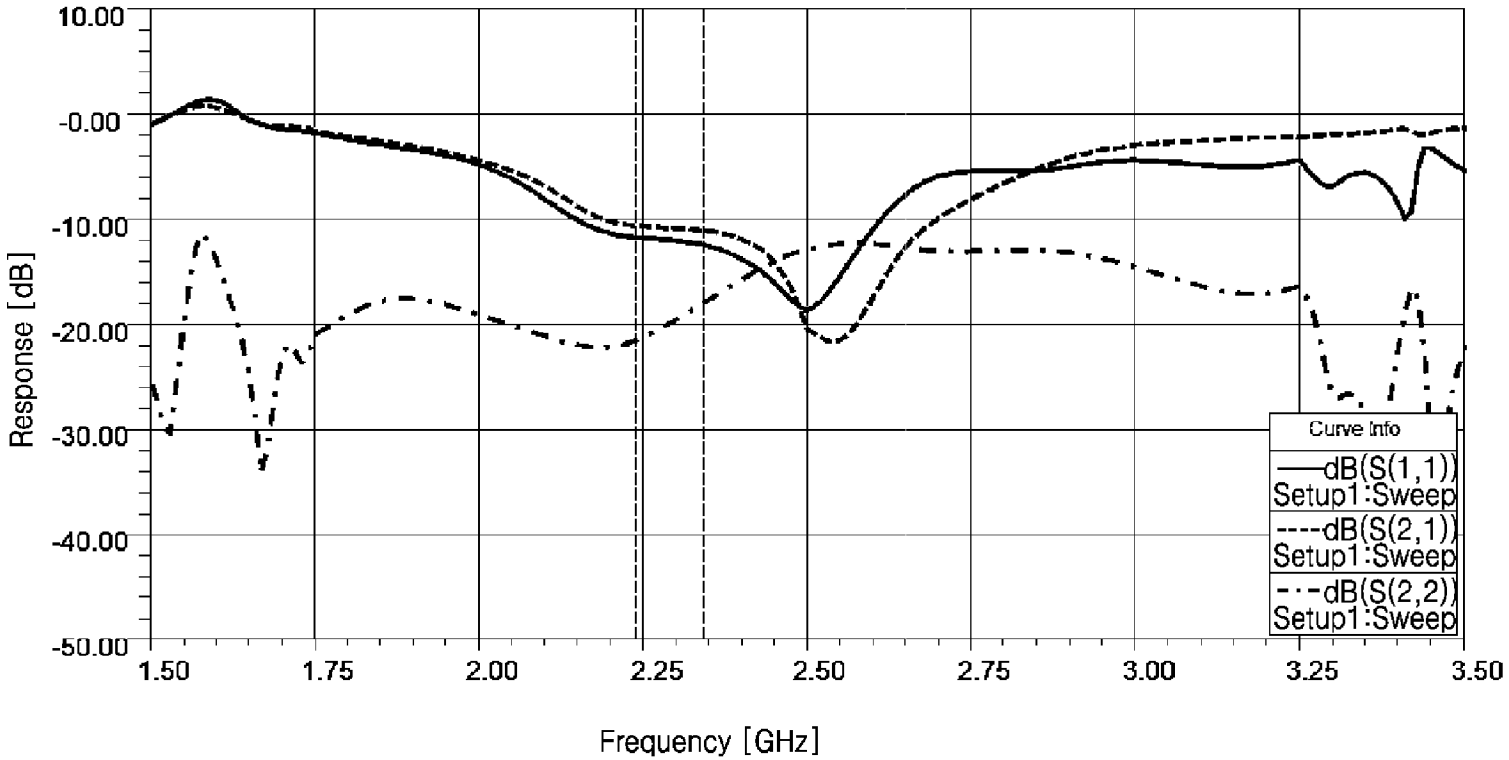
FIG. 21 is a graph of the X-POL isolation characteristics of the fifth comparative example by computational simulation.

FIG. 21 is a graph of the X-POL isolation characteristics of the fifth comparative example by computational simulation.

Figure 22:
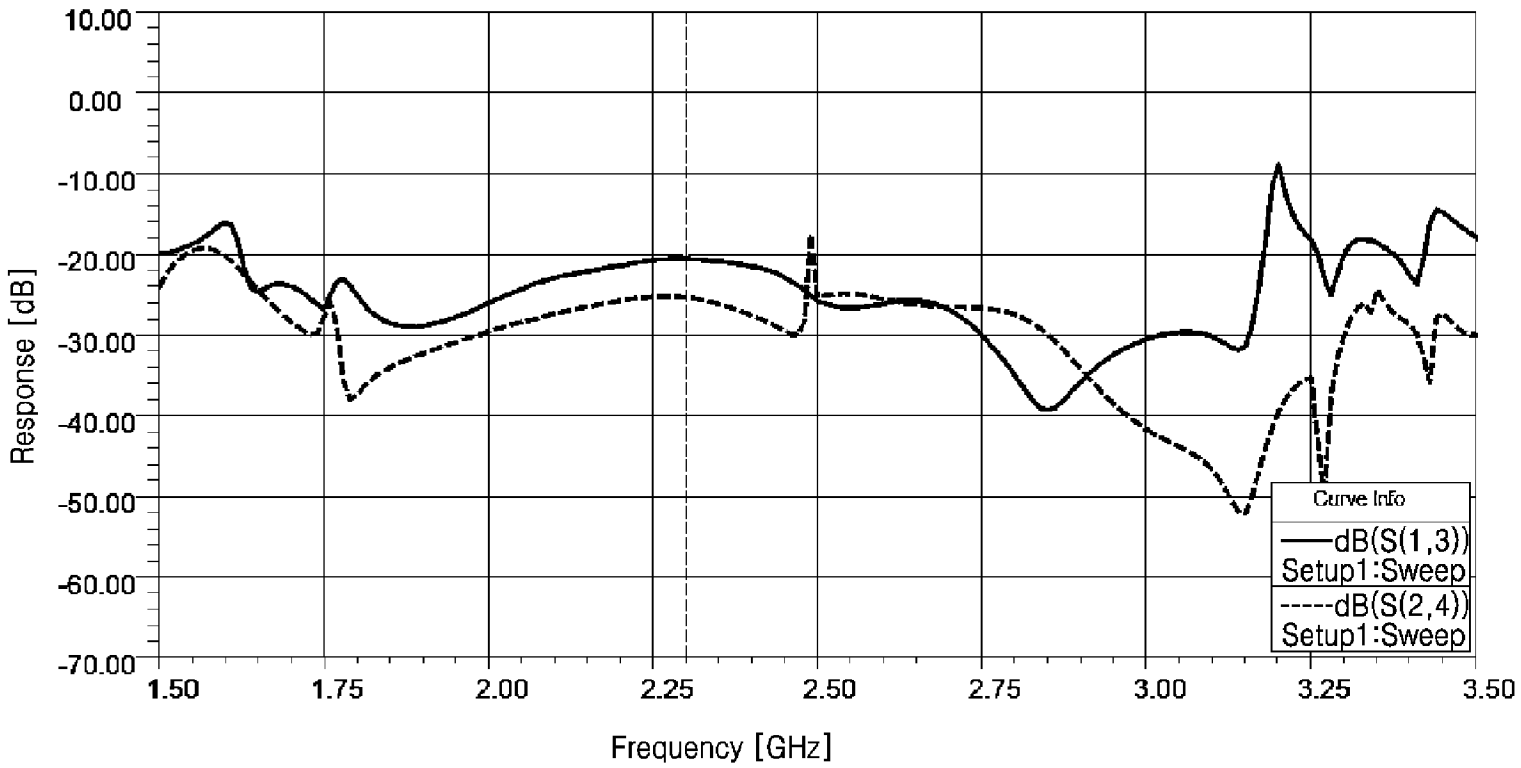
FIG. 22 is a graph of the CO-POL isolation characteristics of the fifth comparative example by computational simulation.

FIG. 22 is a graph of the CO-POL isolation characteristics of the fifth comparative example by computational simulation.

FIGS. 20 to 22 as compared with the results of FIG. 17 shows a very narrow ground area of the edges 510 of the base substrate 310, resulting in a degraded frequency characteristic of the antenna modules 110 located at the edge 510. In this case, the CO-POL isolation characteristics indicated by computational simulation had −20.6 dB, and X-POL isolation had −17.9 dB, further indicating a return loss by the degradation of 5 dB as compared with the case of FIG. 17.

Accordingly, a computer simulation-based optimization process has been conducted for securing the design specification of the second partition 440 to prevent degradation of the frequency characteristics of the adjacent antenna modules 110 while minimizing the ground area of the edge 510 of the base substrate 310.

Figure 23:
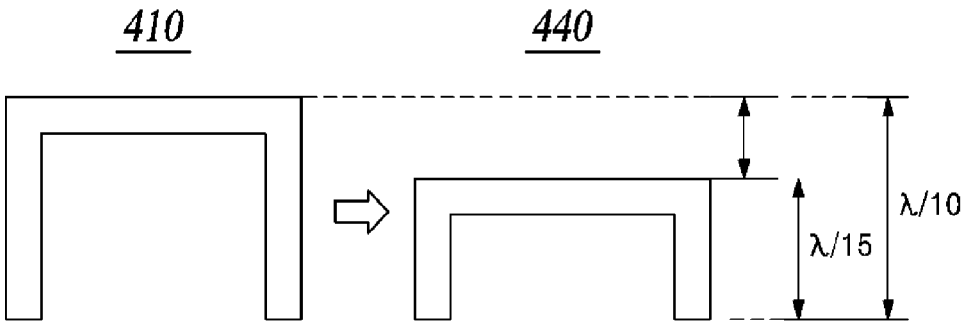
FIG. 23 is a schematic view of a second partition of the outermost second shield wall of the antenna device according to at least one embodiment of the present disclosure.

FIG. 23 is a schematic view of a second partition of the outermost second shield wall of the antenna device according to at least one embodiment of the present disclosure.

As shown in FIG. 23, formed to have a lower height than the first shield wall 42 disposed at an inner side, the horizontal shielding member 412 is included in each of the second partitions 440 for constituting the second shield wall 43 disposed at the edge 510 of the antenna device according to at least one embodiment of the present disclosure. As a result of a computer simulation-based optimization, the horizontal shielding member 412 has been determined to have a second clearance height that is shorter λ/15 but exhibiting the best qualities as compared with the first clearance height of the inwardly disposed unit partition 410, which is λ/10. In other words, each of the second partitions 440 disposed at the edge 510 has vertical shielding members 414' which preferably extend by a height of λ/15.

Figure 24:
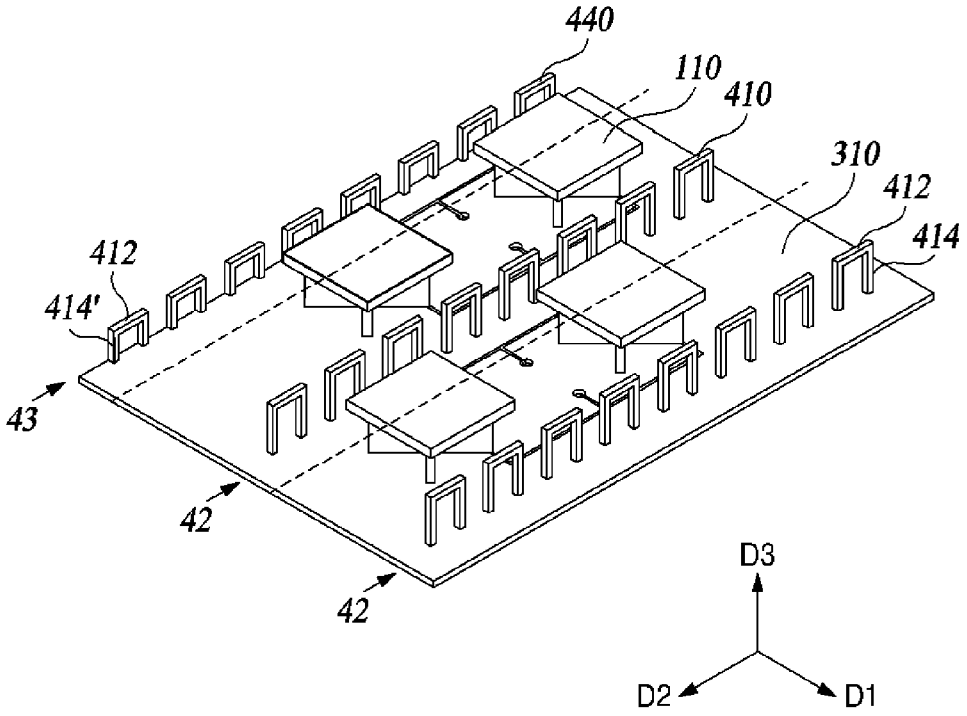
FIG. 24 is a schematic diagram of second partitions employed at an outermost second shield wall of the antenna device according to at least one embodiment of the present disclosure.

FIG. 24 is a schematic diagram of second partitions employed at an outermost second shield wall of the antenna device according to at least one embodiment of the present disclosure.

Figure 25:
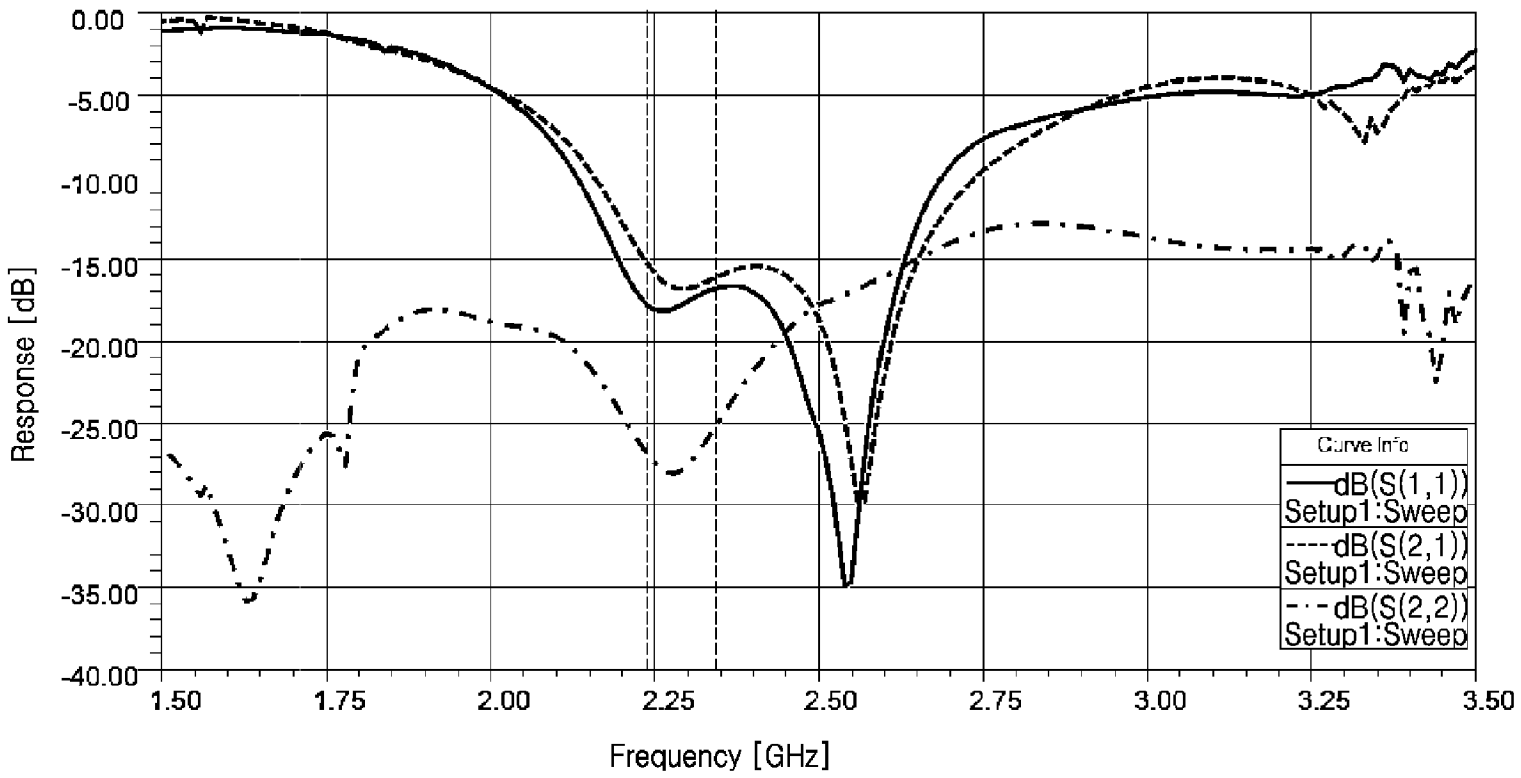
FIG. 25 is a graph by computational simulation of the X-POL isolation characteristics of the embodiment of FIG. 24 with the second partitions being employed.

FIG. 25 is a graph by computational simulation of the X-POL isolation characteristics of the embodiment of FIG. 24 with the second partitions being employed.

Figure 26:
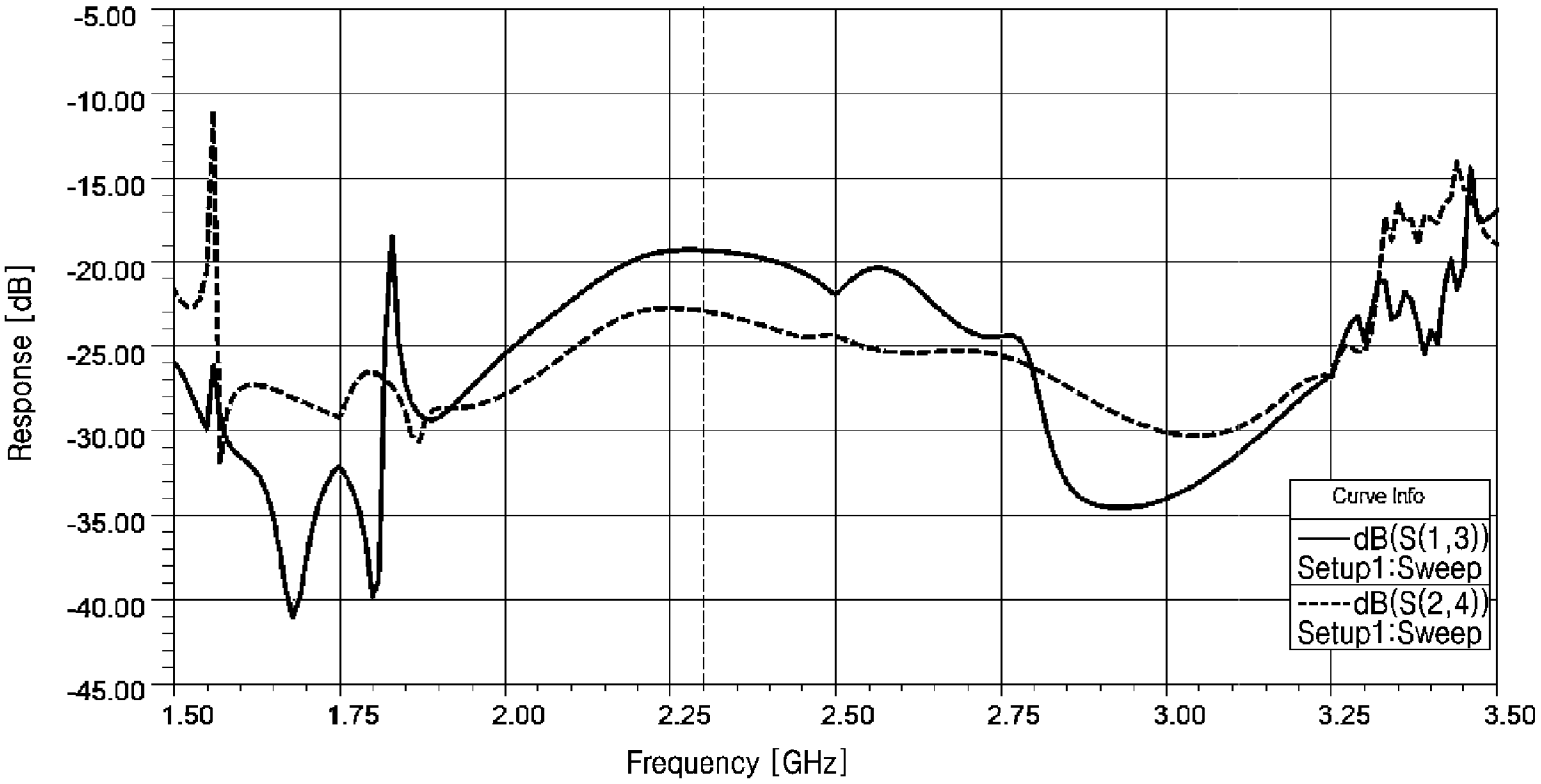
FIG. 26 is a graph by computational simulation of the CO-POL isolation characteristics of the embodiment of FIG. 24 with the second partitions being employed.

FIG. 26 is a graph by computational simulation of the CO-POL isolation characteristics of the embodiment of FIG. 24, with the second partitions being applied.

As shown in FIG. 24, the second shield wall 43, according to at least one embodiment of the present disclosure, is set to have a height of λ/15 when it is disposed at both edges 510 and to have a height of λ/10 when disposed between the antenna modules 110.

As shown in FIGS. 25 and 26, CO-POL isolation characteristics have −19.3 dB, and X-POL isolation −25.1 dB, indicating no significant degradation in the characteristics of the antenna modules 110 located at the outer sides. Compared to the case of FIG. 20, the elevation of the horizontal shield member 412 is determined to be closer to the base substrate 310 so that the return loss has been improved back by 5 dB to achieve a value as good as having wide ground areas arranged at the edges 510.

An antenna device according to at least one embodiment of the present disclosure can provide a massive MIMO antenna capable of providing sufficient performance within a reduced overall dimension by lowering the height of the shield wall 42 disposed at both edges 510 of the antenna device relative to the shield wall 42 disposed at the inner side. As shown in FIG. 15, the second shield walls 43 disposed at both edges 510 of the antenna device may be fabricated by forming the second partitions 440 into the conductive pattern units 430 erected on the printed circuit board.

The shield walls 42 and 43, according to various embodiments of the present disclosure are capable of attenuating a beam penetrating the shield wall 42 or reflected from the shield walls 42 and 43. With the shield walls 42 and 43 in which the unit partitions 410 and conductive pattern units 430 are employed according to at least one embodiment of the present disclosure, the antenna modules 110 can be implemented with the freedom of arrangement.

Figure 27A:
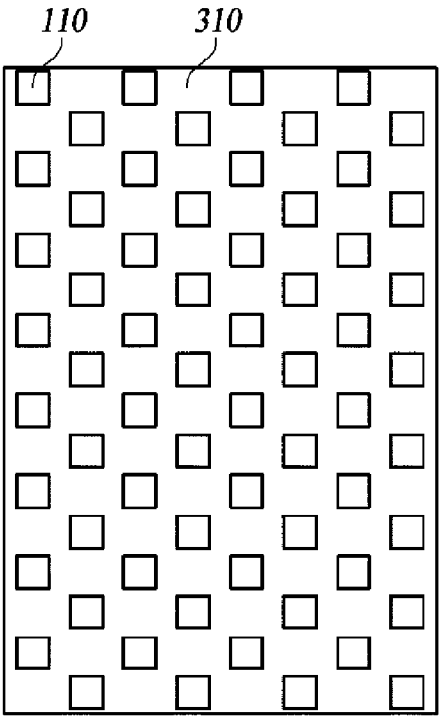
FIGS. 27A and 27B are conceptual diagrams of two configurations in which antenna modules are disposed on a reflector.
Figure 27B:
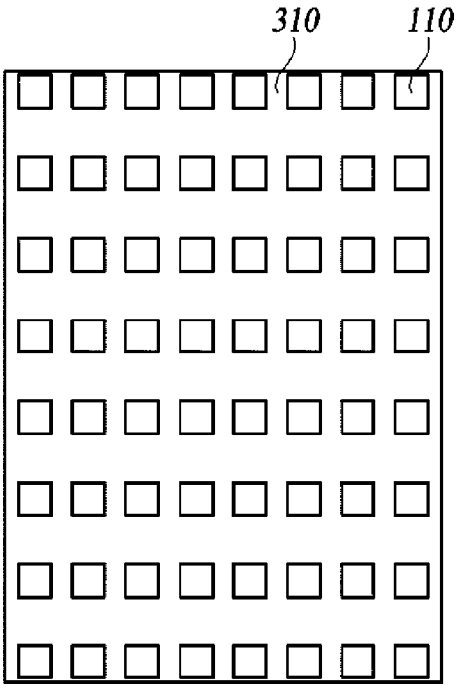

FIGS. 27A and 27B are conceptual diagrams of two configurations in which antenna modules are disposed on a reflector.

Referring back to FIG. 1, when the shield walls 920 are so disposed to cover all four sides of the antenna modules 110, the antenna modules 110 are arrayed with their lateral edges lined up in a check pattern to have the least possible space occupied over the entire antenna device as shown in FIG. 27B. However, when the shield walls 42 are placed only in second direction D2 as in some embodiments of the present disclosure, issues with the X-POL isolation characteristics need to be avoided generally by arranging the antenna modules 110 as shown in FIG. 2. Namely, the antenna modules 110 are arrayed with their lateral edges alternated as in the checkerboard grid, as shown in FIG. 27A.

Figure 28:
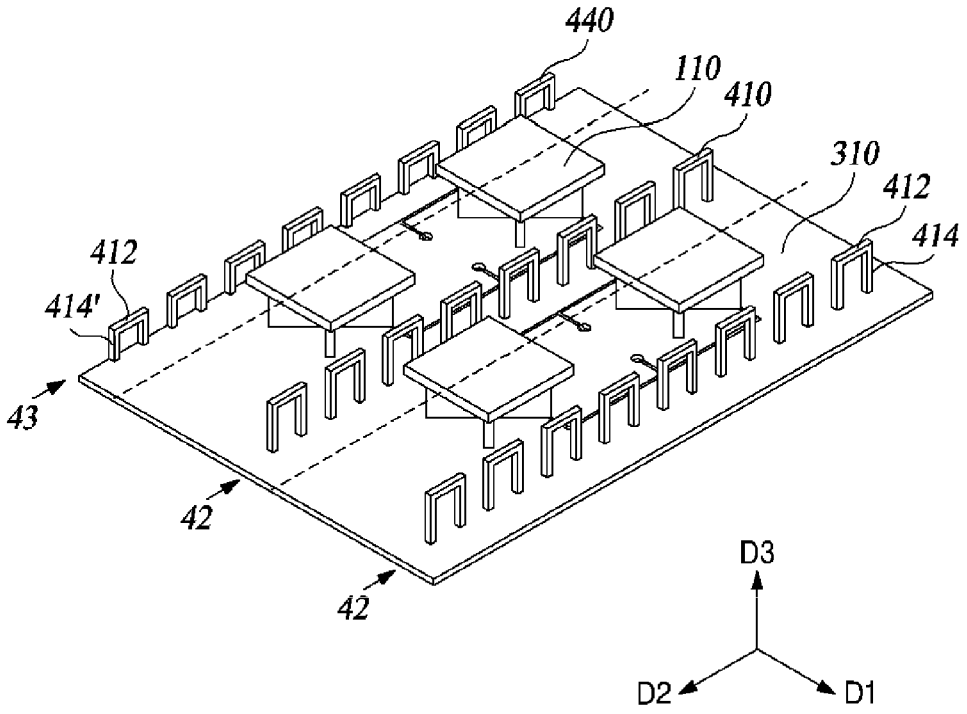
FIG. 28 is a conceptual diagram of an antenna device having antenna modules arranged side by side in a row in two directions according to at least one embodiment of the present disclosure.

FIG. 28 is a conceptual diagram of an antenna device having antenna modules arranged side by side in a row in two directions according to at least one embodiment of the present disclosure.

Figure 29:
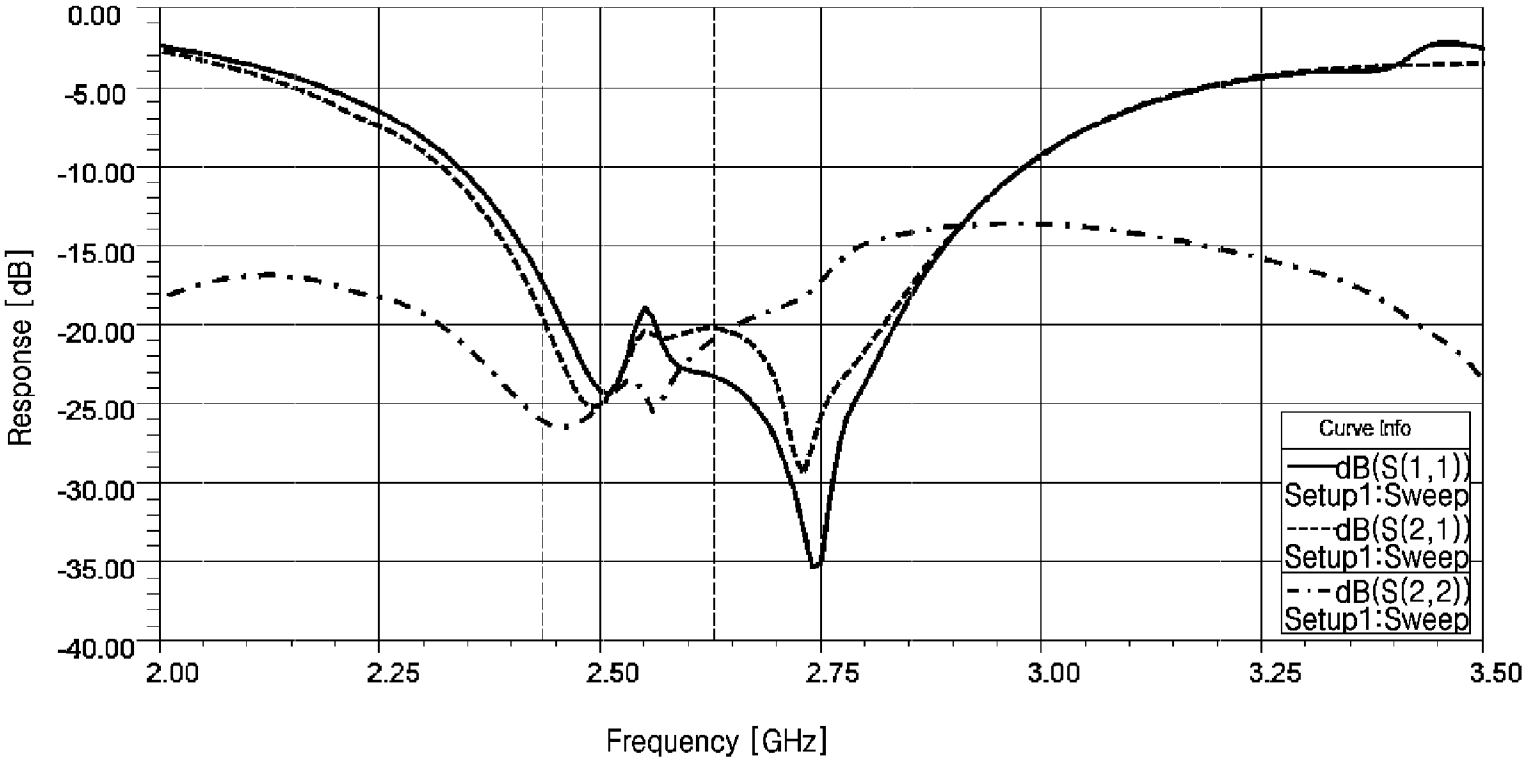
FIG. 29 is a graph of the X-POL isolation characteristics of the embodiment of FIG. 28 by computational simulation.

FIG. 29 is a graph of the X-POL isolation characteristics of the embodiment of FIG. 28 by computational simulation.

Figure 30:
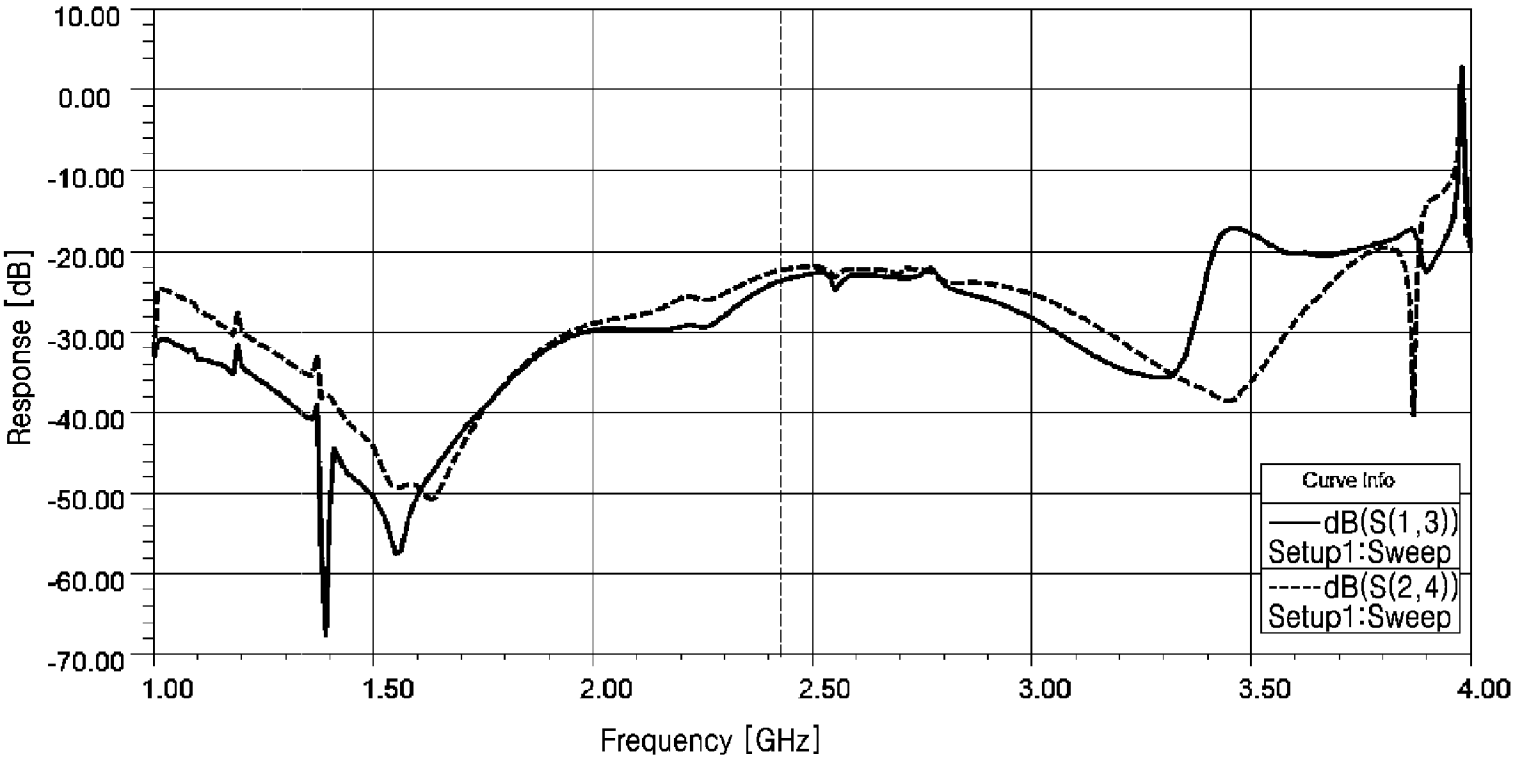
FIG. 30 is a graph of the CO-POL isolation characteristics of the embodiment of FIG. 28 by computational simulation.

FIG. 30 is a graph of the CO-POL isolation characteristics of the embodiment of FIG. 28 by computational simulation.

As shown in FIG. 28, the antenna modules 110 according to at least one embodiment of the present disclosure are laid out so that the antenna modules 110 as arrayed in first direction D1 do not alternate but lie in parallel with the antenna modules 110 as arrayed neighboring each other in second direction D2. The embodiment of FIG. 28 is a case similar to the fifth comparative example of FIG. 20 except for the antenna modules 110 as being arrayed in parallel with each other.

According to the computational simulations shown in FIGS. 29 and 30, the CO-POL isolation characteristics have −22.4 dB and the X-POL isolation −20.8 dB, indicating the shielding characteristics rather superior to the arrangement of FIG. 20 wherein the CO-POL isolation has −20.6 dB, and the X-POL isolation has −17.9 dB. This may be construed that the unit partitions 410 (or the conductive pattern units 430) according to at least one embodiment of the present disclosure can effectively attenuate beams radiated toward the lateral edges of the antenna modules 110 and at the same time that beams radiated from neighboring antenna modules are effectively canceled by their phase difference or the like at the positions of the shield walls 42.

By using the shield wall 42 employing the unit partitions 410 (or the conductive pattern units 430) according to at least one embodiment of the present disclosure, the same number of antenna modules can be effectively arrayed taking a smaller footprint. Besides, as shown in FIG. 23, the second partitions 440 as employed at the edge 510 of the antenna device can reduce the antenna device by the size in first direction D1.

Although exemplary embodiments of the present disclosure have been described for illustrative purposes, those skilled in the art will appreciate that various modifications, additions, and substitutions are possible, without departing from the idea and scope of the claimed invention. Therefore, exemplary embodiments of the present disclosure have been described for the sake of brevity and clarity. The scope of the technical idea of the present embodiments is not limited by the illustrations. Accordingly, one of ordinary skill would understand the scope of the claimed invention is not to be limited by the above explicitly described embodiments but by the claims and equivalents thereof.

The invention claimed is:

1. An antenna device, comprising:

a base substrate;

an antenna module array comprising a plurality of rows of antenna modules arranged in a first direction, each of the plurality of rows of antenna modules including a plurality of antenna modules that are dual-polarized and arranged in a second direction perpendicular to the first direction along a line on the base substrate; and a first shield wall disposed between the plurality of rows of antenna modules adjacent to each other, the first shield wall being formed by a plurality of unit partitions arranged in the second direction and spaced apart from each other, wherein each of the unit partitions comprises:

a plurality of vertical shield members having one ends mounted on the base substrate; and a plurality of horizontal shielding members each being connected to adjacent vertical shield members and spaced apart from the base substrate by a first height, and wherein each of the plurality of horizontal shield members has a length that is less than an array spacing of the antenna module array in the first direction.

2. The antenna device of claim 1, wherein each of the unit partitions is made of a conductive linear member.

3. The antenna device of claim 1, wherein the plurality of the horizontal shield members are arranged in a row along the second direction.

4. The antenna device of claim 3, wherein each of the horizontal shield members is linear.

5. The antenna device of claim 4, wherein the length of each of the plurality of horizontal shield members allows a mutual frequency interference to be reduced in proportion to a reduced array spacing between the antenna modules.

6. The antenna device of claim 4, wherein multiples of the horizontal shielding member have an array spacing determined to reduce a mutual interference between the antenna modules due to radio waves reflected by the unit partitions, the array spacing comprising an array spacing that is measured in the second direction between the multiples of the horizontal shielding member to be equal to or less than an integer multiple of the length of the horizontal shielding member.

7. The antenna device of claim 5, wherein the length of the horizontal shield member is equal to or less than a quarter of the array spacing of the antenna module array in the first direction.

8. The antenna device of claim 6, wherein the array spacing of the multiples of the horizontal shielding member is at most twice the length of the horizontal shielding member.

9. The antenna device of claim 1, wherein the unit partitions each include two vertical shielding members, which have one ends connected to the base substrate and other ends connected to both ends of the horizontal shielding member, respectively.

10. An antenna device, comprising:

a base substrate;

an antenna module array comprising a plurality of rows of antenna modules arranged in a first direction, each of the plurality of rows of antenna modules including a plurality of antenna modules that are dual-polarized and arranged in a second direction perpendicular to the first direction along a line on the base substrate; and a first shield wall disposed between the plurality of rows of antenna modules adjacent to each other, the first shield wall being formed by a plurality of unit partitions arranged in the second direction and spaced apart from each other, wherein each of the unit partitions comprises:

a plurality of vertical shield members having one ends mounted on the base substrate; and a plurality of horizontal shielding members each being connected to adjacent vertical shield members and spaced apart from the base substrate by a first height, and wherein the antenna device further comprises second shield walls disposed on the plurality of rows of antenna modules at both outer sides respectively, distally in the first direction, the second shield walls being formed by a plurality of unit partitions arranged in the second direction and spaced apart from each other, wherein the unit partitions of the second shield wall each include a horizontal shielding member spaced apart from the base substrate by a second height, which is lower than the first height.

11. The antenna device of claim 1, wherein the vertical shield members have other ends further including connection terminals formed to connect each of the unit partitions to the base substrate.

12. The antenna device of claim 11, wherein the connection terminals each include a pin member inserted through the base substrate.

13. The antenna device of claim 11, wherein the connection terminals each include a lead member extending in parallel with the base substrate, and the lead member is configured to be soldered onto the base substrate.

14. An antenna device, comprising:

a base substrate;

an antenna module array comprising a plurality of rows of antenna modules arranged in a first direction, each of the plurality of rows of antenna modules including a plurality of antenna modules that are dual-polarized and arranged in a second direction perpendicular to the first direction along a line on the base substrate; and a first shield wall disposed between the plurality of rows of antenna modules adjacent to each other, the first shield wall being formed by a plurality of unit partitions arranged in the second direction and spaced apart from each other, wherein the unit partitions are composed of a printed circuit board erected on the base substrate and a conductive pattern formed on the printed circuit board.

* * * * *